US008002906B2

(12) United States Patent
Suzuki et al.

(10) Patent No.: US 8,002,906 B2
(45) Date of Patent: Aug. 23, 2011

(54) RARE EARTH MAGNET AND PRODUCTION PROCESS THEREOF

(75) Inventors: Shunji Suzuki, Nagoya (JP); Hayato Hashino, Nagoya (JP); Masahiro Hiraoka, Nagoya (JP); Takao Yabumi, Nagoya (JP)

(73) Assignee: Daido Tokushuko Kabushiki Kaisha, Nagoya (JP)

( * ) Notice: Subject to any disclaimer, the term of this patent is extended or adjusted under 35 U.S.C. 154(b) by 31 days.

(21) Appl. No.: 12/494,902

(22) Filed: Jun. 30, 2009

(65) Prior Publication Data

US 2010/0003156 A1 Jan. 7, 2010

(30) Foreign Application Priority Data

Jul. 4, 2008 (JP) ..... 2008-175675
Apr. 6, 2009 (JP) ..... 2009-091688
May 28, 2009 (JP) ..... 2009-128779

(51) Int. Cl.
*H01F 1/057* (2006.01)

(52) U.S. Cl. ..... 148/302; 148/101

(58) Field of Classification Search ..... None
See application file for complete search history.

(56) References Cited

U.S. PATENT DOCUMENTS

2005/0284545 A1* 12/2005 Komuro et al. ..... 148/302
2006/0278517 A1 12/2006 Machida et al. ..... 204/192.1
2007/0034299 A1 2/2007 Machida et al. ..... 148/105
2007/0125452 A1* 6/2007 Hirota et al. ..... 148/302
2008/0006345 A1 1/2008 Machida et al. ..... 148/120
2008/0286595 A1* 11/2008 Yoshimura et al. ..... 428/548

FOREIGN PATENT DOCUMENTS

| | | |
|---|---|---|
| EP | 0237416 | 9/1987 |
| EP | 0517179 | 12/1992 |
| JP | 62-206802 | 9/1987 |
| JP | 05-021218 | 1/1993 |
| JP | 2006-179963 | 7/2006 |
| JP | 2006-303436 | 11/2006 |

* cited by examiner

*Primary Examiner* — John Sheehan
(74) *Attorney, Agent, or Firm* — Bacon & Thomas, PLLC

(57) ABSTRACT

The present invention provides a rare earth magnet, which is formed through at least hot molding, the rare earth magnet containing grains including an $R_2X_{14}B$ phase as a main phase, and a grain boundary phase surrounding peripheries of the grains, in which R is at least one element selected from the group consisting of Nd, Pr, Dy, Tb and Ho, and X is Fe or Fe with a part being substituted by Co; in which an element RH is more concentrated in the grain boundary phase than in the grains, in which the element RH is at least one element selected from the group consisting of Dy, Tb and Ho; and the element RH is present with a substantially constant concentration distribution from the surface part of the magnet to the central part of the magnet.

15 Claims, 4 Drawing Sheets

RARE EARTH MAGNET AND PRODUCTION PROCESS THEREOF

FIELD OF THE INVENTION

The present invention relates to a rare earth magnet and a production process thereof.

BACKGROUND OF THE INVENTION

Conventionally, a rare earth magnet such as Nd—Fe—B type has been used in a room temperature environment, for example, in a voice coil motor (VCM) of a hard disk drive or in a magnetic resonance imaging (MRI) device, and therefore, heat resistance has almost never been required so far.

In recent years, this type of rare earth magnet is expanding its application, for example, to an EPS motor of general vehicles, a driving motor of hybrid electric vehicles (HEV), or a motor for FA (robot or machine tool). Along with such expansion of the application range, the rare earth magnet is required to have heat resistance and be capable of withstanding use in a relatively high temperature environment. This tendency is strong particularly in the application to automobiles.

The most common method for elevating the heat resistance of the rare earth magnet is to increase the coercive force, and a method of adding Dy, Tb or the like at the melting of Nd—Fe—B-based alloy has long been employed.

Recently, an attempt to increase the coercive force by diffusing a Dy metal into the inside from the surface of the rare earth magnet has been made. For example, International Publication No. WO2006/064848, pamphlet (claims, FIG. 1, etc.) discloses an Nd—Fe—B-based sintered magnet and a production process thereof, where a fluoride, oxide or chloride of Dy is treated by reduction to cause diffusion and penetration of a Dy metal into a grain boundary phase from the surface of the Nd—Fe—B-based sintered magnet, whereby the grain boundary is modified to give a high Dy concentration on the magnet surface and a low Dy concentration in the inside of the magnet.

Also, for example, JP-A-2004-304038 discloses a rare earth sintered magnet and a production process thereof, where a Dy or Tb metal film is formed by sputtering on the surface of the rare earth sintered magnet, followed by subjected to a heat treatment, thereby thermally diffusing Dy or the like inside of the magnet.

In addition, JP-A-62-206802 describes a method of mixing a Dy—Nb alloy powder, a Dy—V alloy powder or the like with an Nd—Fe—B-based alloy powder and sintering the powder mixture to obtain a sintered magnet.

However, these conventional techniques have the following problems. That is, in the method of adding Dy, Tb or the like at the melting of an Nd—Fe—B-based alloy, the coercive force is increased utilizing a principle of increasing the magnetic anisotropy by replacing Nd of $Nd_2Fe_{14}B$ crystal with Dy or the like, but in accordance with this principle, Dy or the like and the Fe atom are coupled together magnetically antiparallel to each other, which disadvantageously causes reduction of remanence.

The technique described in WO2006/064848 where a Dy metal is caused to diffuse and penetrate into a grain boundary phase from the surface of a rare earth sintered magnet is applicable to a sintered magnet, but this technique can be hardly applied to a magnet produced through hot molding such as hot press or hot plastic working such as hot extrusion. The reasons therefor are as follows.

According to the technique described in WO2006/064848, a heat treatment at a high temperature of around 1,000° C. is necessary for thoroughly reducing and diffusing Dy. In the case of a sintered magnet, the magnet itself is sintered at about 1,100° C. and therefore, hardly causes grain growth under the above-described heat treatment conditions, and the problem of reduction in the coercive force due to increase of the grain growth can be almost disregarded. On the other hand, the magnet produced through hot molding or hot plastic working allows grain growth under the above-described heat treatment conditions, so that the elevation of coercive force by virtue of Dy diffusion and the decrease of coercive force due to grain growth cancel each other. Also, when the grain size is increased, the magnetic domain becomes unstable and the coercive force decreases. For these reasons, it has been difficult to apply the technique described in WO2006/064848 to a magnet produced through hot molding or hot plastic working to enhance the heat resistance thereof.

As for the technique described in JP-A-2004-304038 where a metal film of Dy or Tb is formed by sputtering on the surface of a rare earth sintered magnet and such a metal is thermally diffused into the inside of the magnet, an expensive apparatus is necessary for the formation of metal film. Furthermore, because of batch production of small amounts) the productivity is low.

In both of the techniques described in WO2006/064848 and JP-A-2004-304038, Dy or the like is caused to diffuse into the inside of the magnet from the magnet surface and therefore, while the concentration of Dy or the like is high in the surface part of the magnet, the concentration of Dy or the like is low in the inside of the magnet and, as a result, the magnetic characteristics of the entire magnet are likely to become non-uniform. This is disadvantageous in obtaining high magnetic characteristics over the entire magnet. Other than WO2006/064848 and JP-A-2004-304038, a large number of methods for diffusing Dy into the inside of the magnet from the magnet surface are disclosed, but these methods all are relying on the diffusion from the magnet surface and although there are some differences, the non-uniformity of magnetic characteristics due to difference in the Dy concentration between the surface and the inside of a magnet cannot be avoided.

The method described in JP-A-62-206802 where a Dy—Nb alloy powder or the like is mixed with an Nd—Fe—B-based alloy powder and the powder mixture is sintered, the sintering temperature is as high as about 1,100° C. Accordingly, the grains have a size of from 5 to 10 μm and in view of single domain theory, this is disadvantageous in obtaining a large coercive force and is fundamentally not preferred. In addition, since the element Dy mostly diffuses into the inside of a main grain during high-temperature sintering, despite an increase of the coercive force, there is a drawback that reduction in the remanence becomes large.

SUMMARY OF THE INVENTION

The present invention has been made under these circumstances and an object of the present invention is to provide a rare earth magnet exhibiting a high coercive force while suppressing reduction of the remanence. Another object of the present invention is to provide a production process capable of simply and easily producing a rare earth magnet having uniform magnetic characteristics.

For attaining these objects, the present invention provides:

a rare earth magnet, which is formed through at least hot molding, the rare earth magnet comprising grains including an $R_2X_{14}B$ phase as a main phase, and a grain boundary phase surrounding peripheries of the grains, in which R is at least one element selected from the group consisting of Nd, Pr, Dy, Tb and Ho, and X is Fe or Fe with a part being substituted by Co;

wherein an element RH is more concentrated in the grain boundary phase than in the grains, in which the element RH is at least one element selected from the group consisting of Dy, Tb and Ho; and wherein the element RH is present with a substantially constant concentration distribution from the surface part of the magnet to the central part of the magnet.

The rare earth magnet of the invention preferably has a concentration difference of the element RH in the depth direction from the surface part of the magnet to the inside of the magnet within 10%.

In the rare earth magnet of present invention, the average grain size of the grains is preferably 1 μm or less.

In the rare earth magnet of present invention, R preferably contains at least Nd and/or Pr.

In the rare earth magnet of the present invention, the content of the element RH is preferably from 0.01 to 10 mass %.

In addition, the rare earth magnet of the present invention is preferably formed at least by hot molding a raw material powder containing an R—X—B-based alloy powder mixed or coated with an RH metal and/or an RH alloy.

In this regard, the raw material powder preferably contains from 0.01 to 10 mass % of the RH metal and/or the RH alloy.

In addition, the RH alloy preferably contains at least one element selected from the group consisting of Cu, Al, Ga, Ge, Sn, In, Si, Ag, Au, Pd, Co, Fe, Ni, Cr and Mn.

Furthermore, the present invention provides:

a process for producing a rare earth magnet, the process comprising:

a step of preparing a raw material powder containing an R—X—B-based alloy powder mixed or coated with an RH metal and/or an RH alloy, in which R is at least one element selected from the group consisting of Nd, Pr, Dy, Tb and Ho, X is Fe or Fe with a part being substituted by Co, and RH is at least one element selected from the group consisting of Dy, Tb and Ho;

a step of cold molding said prepared raw material powder to obtain a cold compact; and a step of hot molding said obtained cold compact to obtain a hot compact or subjecting said obtained hot compact further to hot plastic working to obtain a hot plastic worked body.

In the process of the invention, the raw material powder preferably contains from 0.01 to 10 mass % of the RH metal and/or the RH alloy.

The process of the invention preferably further includes a step of subjecting the hot compact or the hot plastic worked body to a heat treatment.

In this regard, the heat treatment is preferably conducted at a temperature of from 500 to 900° C.

In the process of the invention, the RH alloy preferably contains at least one element selected from the group consisting of Cu, Al, Ga, Ge, Sn, In, Si, Ag, Au, Pd, Co, Fe, Ni, Cr and Mn.

The rare earth magnet according to the present invention is a magnet formed through at least hot molding and contains grains including an $R_2X_{14}B$ phase as a main phase (in which R is at least one element selected from the group consisting of Nd, Pr, Dy, Tb and Ho, and X is Fe or Fe with a part being substituted by Co) and a grain boundary phase surrounding peripheries of the grains. Further, in the rare earth magnet according to the invention, an element RH (wherein element RH is at least one element selected from the group consisting of Dy, Tb and Ho) which is more concentrated in the grain boundary phase than in the grains is present with a substantially constant concentration distribution from the surface part of the magnet to the central part of the magnet.

Therefore, compared with a conventional rare earth magnet where the concentration of the element RH is high in the surface part of the magnet and the concentration of the element RH is low inside the magnet, the rare earth magnet according to the present invention exhibits high coercive force while uniformly suppressing reduction of the remanence in the magnet. Accordingly, the rare earth magnet of the present invention is capable of exerting high heat resistance.

Herein, when the rare earth magnet of the invention has a concentration difference of the element RH in the depth direction from the surface part of the magnet to the inside of the magnet within 10%, the homogeneity of the element RH inside the magnet is excellent, which tends to contribute to the elevation of coercive force.

In addition, when the average grain size of the grains is 1 μm or less, since the grain size becomes closer to the single domain critical size, stabilization of the magnetic domain becomes easy and generation or propagation of a reverse magnetic domain hardly occurs. As a result, reduction of the coercive force is easily suppressed, which can contribute to elevation of the coercive force.

Also, in the case where R contains at least Nd and/or Pr, the saturated magnetization becomes relatively high, which can contribute to the enhancement of magnetization.

In the case where the content of the element RH is from 0.01 to 10 mass %, reduction of the remanence is suppressed and it becomes easy to effectively enhance the coercive force.

Furthermore, when the rare earth magnet according to the present invention is formed at least by hot molding a raw material powder containing an R—X—B-based alloy powder mixed or coated with an RH metal and/or an RH alloy, uniform diffusion of the element RH inside the magnet can be achieved and the coercive force can be increased with high efficiency.

In the case where the RH alloy contains at least one element selected from the group consisting of Cu, Al, Ga, Ge, Sn, In, Si, Ag, Au, Pd, Co, Fe, Ni, Cr and Mn, since such secondary alloy element forms a eutectic crystal with the element RH, the melting point of the RH alloy becomes low compared with that of RH metal alone. As a result, internal diffusion of the element RH can be performed at a lower temperature and growth of the grains is likely to be suppressed, which can contribute to the elevation of coercive force. Furthermore, a part of the RH alloy is converted into a liquid phase during hot molding, and this is effective also for densification of the magnet compact or enhancement of the plastic workability.

In the production process of a rare earth magnet according to the present invention, the above-described specific raw material powder is prepared, the prepared raw material powder is cold molded, and the obtained cold compact is hot molded or the obtained hot compact is subjected further to hot plastic working. Consequently, the element RH can be internally diffused into the grain boundary phase in a homogeneous and highly efficient manner.

The reason therefor is considered because, in a conventional method of diffusing the element RH from the surface of a magnet into the inside of the magnet, the diffusion length of the element RH is approximately from several to several tens of mm corresponding to the size of the magnet, but in the production process of a rare earth magnet according to the present invention, the diffusion length of the element RH can be as small as approximately from 1/100 to 1/1000 of the above and this is very advantageous for uniform diffusion.

For this reason, according to the production process of a rare earth magnet of the present invention, a rare earth magnet where the element RH concentrated in the grain boundary phase and present with a substantially constant concentration distribution from the surface part of the magnet to the central part of the magnet can be produced relatively in an easy and simple manner without the necessity of an expensive film-forming apparatus such as sputtering apparatus. Also, in the case of producing a plurality of rare earth magnets by cutting the obtained rare earth magnet, rare earth magnets having the same properties are easily obtained, and excellent mass productivity is achieved.

Here, in the case where the raw material powder contains from 0.01 to 10 mass % of the RH metal and/or the RH alloy, reduction of the remanence of the obtained rare earth magnet is suppressed and the coercive force is likely to be effectively enhanced.

Also, in the case that the process further includes a step of subjecting the hot compact or the hot plastic worked body to a heat treatment, internal diffusion of the element RH into the grain boundary phase is likely to be effected more homogeneously.

In the case where the temperature during the heat treatment is from 500 to 900° C., it becomes easy not only to sufficiently diffuse the element RH into the grain boundary phase but also to cause the majority of the element RH to stay in the grain boundary phase, thereby suppressing substitution of the element RH with the element R in the grains and restraining reduction of the remanence. Also, the grains are prevented from coarsening and a high coercive force is likely to be obtained.

Furthermore, in the case where the RH alloy contains at least one element selected from the group consisting of Cu, Al, Ga, Ce, Sn, In, Si, Ag, Au, Pd, Co, Fe, Ni, Cr and Mn, since almost all of these elements form an eutectic crystal with the element RH, the melting point of the RH alloy becomes low compared with that of the RH metal. As a result, internal diffusion of the element RH can be performed at a lower temperature and growth of the grains is likely to be suppressed, making it easy for the obtained rare earth magnet to have a high coercive force. Furthermore, a part of the RH alloy is converted into a liquid phase during hot molding, and this is effective also for densification of the magnet compact or enhancement of the plastic workability.

DETAILED DESCRIPTION OF THE INVENTION

Figure 1:
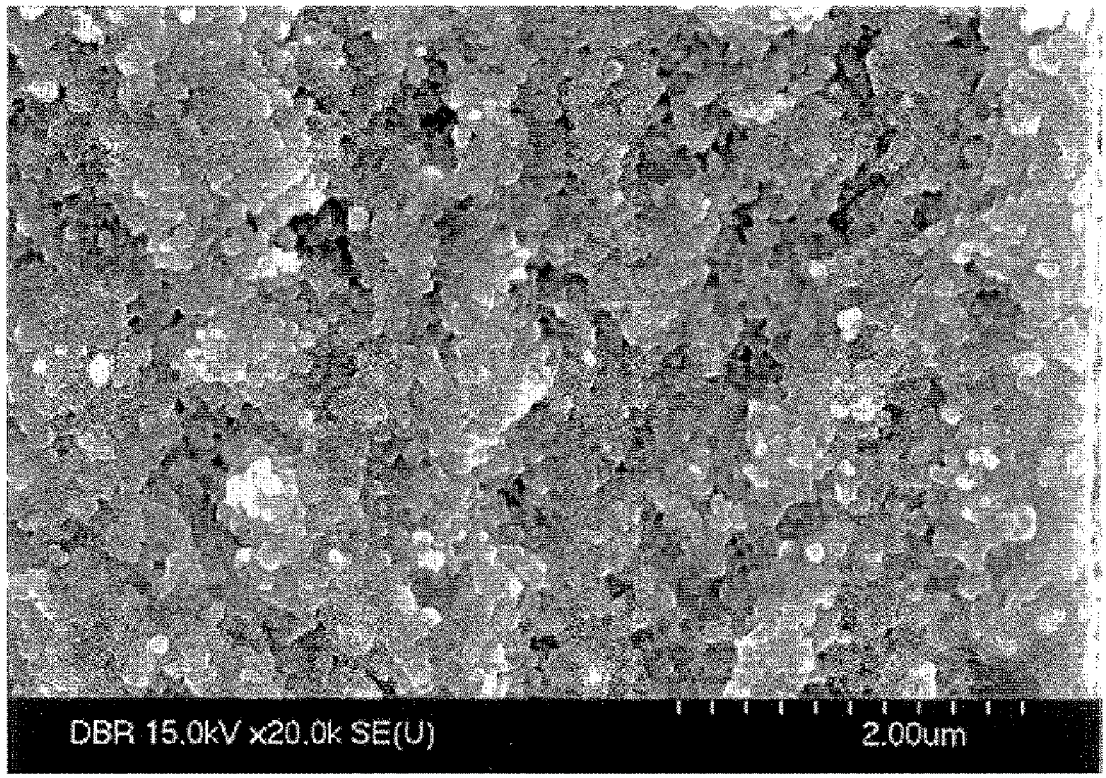
FIG. 1 shows a photograph of Rare Earth Alloy Powder A prepared in Experiment 1, taken using a scanning electron microscope (SEM).

The rare earth magnet according to one embodiment of the present invention (hereinafter sometimes referred to as "the magnet of the invention") and a production process thereof (hereinafter sometimes referred to as "the production process of the invention") are described in detail below.

1. Magnet of the Invention

The magnet of the invention is a magnet formed through at least hot molding and accordingly, is a magnet differing in this point from a so-called sintered magnet.

The magnet of the invention includes grains containing an $R_2X_{14}B$ phase as the main phase, and a grain boundary phase. The grains are fundamentally a plate-like crystal and the grain boundary phase surrounds the peripheries of the grains.

In the magnet of the invention, R is at least one element selected from the group consisting of Nd, Pr, Dy, Tb and Ho. R is preferably Nd or Pr or preferably contains at least Nd and/or Pr, such as a combination containing Nd and/or Pr. More preferably, R contains Nd and/or Pr as the main constituent, because out of the rare earth elements, these are relatively rich in resources and inexpensive and have a relatively high saturated magnetization, facilitating, for example, contribution to the enhancement of magnetic force. Still more preferably, R contains Pr as the main constituent. In the case where R is based mainly on Pr, the anisotropy field of the $R_2X_{14}B$ compound is large compared with the case where R is based mainly on Nd, and this is advantageous, for example, in elevating the coercive force. Also, in the case where R is based mainly on Pr, the melting point of the $R_2X_{14}B$ compound is low compared with the case where R is based mainly on Nd, and this is advantageous, for example, in that the hot plastic workability is enhanced and the crystal orientation is likely to be improved.

As for R, specifically, the ratio of mass % of Nd and/or Pr occupying in the total mass % of the entire R is preferably 50% or more, more preferably 60% or more, still more preferably 70% or more, and most preferably 80% or more.

In the above, X is Fe or Fe with a part being substituted by Co. In view of, for example, magnetic characteristics, particularly large saturated magnetic flux density, and inexpensiveness, X is preferably Fe.

Specific examples of the $R_2X_{14}B$ phase include an $Nd_2Fe_{14}B$ phase, a $Pr_2Fe_{14}B$ phase, an $(Nd,Pr)_2Fe_{14}B$ phase, and a phase resulting from diffusion of an element Dy into these phases and partial substitution by the element, such as $(Nd,Dy)_2Fe_{14}B$ phase, $(Pr,Dy)_2Fe_{14}B$ phase and $(Nd,Pr,Dy)_2Fe_{14}B$ phase.

In the magnet of the invention, the element RH is more concentrated in the grain boundary phase than in the main grains. The element RH is at least one element selected from Dy, Tb and Ho. In view of, for example, excellent balance between the coercive force enhancing effect and the cost, the element RH is preferably Dy or Tb or preferably contains at least Dy and/or Tb, such as a combination containing Dy and/or Tb. More preferably, the element RH contains Dy and/or Tb as the main constituent.

In the magnet of the invention, the element RH is present with a substantially constant concentration distribution from the surface part of the magnet to the central part of the magnet. Herein, the term "substantially constant" means that the concentrations of the element RH at the surface part of the magnet, at the central part of the magnet and at the intermediate part between the surface part and the central part of the magnet are same, or these concentrations differ within an acceptable range in view of measurement error and the like. That is, in the magnet of the invention, the element RH is present in an almost equal concentration in the depth direction from the surface part of the magnet to the inside of the magnet. Accordingly, the magnet of the invention greatly differs in this point from a conventional gradient sintered magnet (such as a magnet described in. e.g., JP-A-2006-

303436 or JP-A-2006-179963) where the concentration of the element RH is high in the surface part of the magnet and the concentration of the element RH is low inside the magnet.

In the magnet of the invention, in view of, for example, excellent homogeneity of the element RH inside the magnet and likelihood of contributing to the elevation of coercive force, the concentration difference of the element RH in the depth direction from the surface part of the magnet to the inside of the magnet is preferably within 10%. In this regard, the concentration difference of the element RH in the depth direction from the surface part of the magnet to the inside of the magnet is obtained by: measuring the concentrations of the element RH at the surface part of the magnet, at the central part of the magnet and at the intermediate part between the surface part and the central part of the magnet; dividing the value of (maximum value among them−minimum value among them) by the maximum value among them, and then multiplying the obtained value by 100. Namely, the concentration difference of the element RH can be calculated according to the following formula.

Concentration difference of element RH={(maximum concentration−minimum concentration)/(maximum concentration)}×100

The concentration difference of the element RH is more preferably within 8%, still more preferably within 5%, still further more preferably within 3%, and most preferably within 2%.

In the magnet of the invention, from the standpoint that, for example, reduction of the remanence is suppressed and the coercive force is likely to be effectively enhanced, the content of the element RH is preferably from 0.01 to 10 mass %, more preferably from 0.02 to 6 mass %, still more preferably from 0.05 to 3 mass %.

The concentration distribution of the element RH can be measured and evaluated by performing EDX analysis of the crystalline structure in the depth direction from the surface part of the magnet to the inside of the magnet. Also, the content of the element RH can be measured and evaluated by the ICP emission spectrochemical analysis or fluorescent X-ray analysis.

Incidentally, the magnet of the invention can be suitably formed by using a raw material powder containing an R—X—B-based alloy powder mixed or coated with an RH metal and/or an RH alloy and passing it through at least hot molding. The RH metal as used herein includes a metal vapor produced by evaporation from the metal and a metal powder. Similarly, the RH alloy includes an alloy vapor produced by evaporation from the alloy and an alloy powder. This is described later in the paragraphs of "2. Production Process of the Invention".

In the magnet of the invention, in view of, for example, ease of suppressing the reduction of coercive force and likelihood of contributing to the elevation of coercive force, the upper limit of the average grain size of grains is preferably 1 μm or less, more preferably 0.5 μm or less. The lower limit of the average grain size is not particularly limited. For example, when hot molding a raw material alloy powder that is in a mixed state of fine grains of about 20 nm and an amorphous phase and is produced by a quenching method, crystallization of the amorphous phase and growth of the fine grains are brought about and a grain size of approximately from 30 to 50 nm results. The amorphous phase does not develop a coercive force but when crystallized to a grain size of 30 to 50 nm, a sufficient coercive force is obtained.

The average grain size of the grains is determined by cutting the magnet of the invention, subjecting it after polishing to SEM observation, drawing several straight lines in an image when the C plane of the $R_2X_{14}B$ crystal is photographed (magnification: 10,000 times), and measuring the lengths of 50 pieces of grains in total, followed by calculating the average of the lengths.

The shape of the magnet of the invention is not particularly limited and can be appropriately selected according to usage from various shapes such as cylindrical, columnar, discotic, plate-like, bar-like, barrel-like and roof tile-like.

As for the applications of the magnet of the invention, suitable examples thereof include a motor working at a high temperature rather than at room temperature, a motor involving large heat generation by its high-speed high-power rotation, such as on-vehicle EPS motor and driving motor, a high-power motor in machine tool, robot and the like, a motor for the outdoor unit of an air conditioner, and an elevator driving motor.

2. Production Process of the Invention

The production process of the invention is a production process capable of suitably producing the magnet of the invention. The production process of the invention fundamentally includes the following steps (1) to (3).

Step (1):

The step (1) is a step of preparing a raw material powder containing an R—X—B-based alloy powder mixed or coated with an RH metal and/or an RH alloy (in which R is at least one element selected from the group consisting of Nd, Pr, Dy, Tb and Ho, X is Fe or Fe with a part being substituted by Co, and RH is at least one element selected from the group consisting of Dy, Tb and Ho). Suitable selections of R, X and RH are as described above.

In the R—X—B-based alloy, from the standpoint of, for example, maintaining high both the coercive force and the remanence, which are used as the evaluation indicator for magnetic characteristics, the R content is preferably from 27 to 33 mass %, more preferably from 28 to 32 mass %, still more preferably from 28.5 to 31 mass %.

X is Fe alone or Fe with a part being substituted by Co. The substitution by Co has an effect of raising the Curie temperature of the $R_2Fe_{14}B$ compound and enhancing the corrosion resistance, but on the other hand, if excessively substituted, the remanence and the like decrease. For this reason, in the R—X—B-based alloy, the Co content is preferably 6 mass % or less, more preferably 3 mass % or less.

In the R—X—B-based alloy, from the standpoint of allowing easy production of the $R_2X_{14}B$ compound without causing decrease in the remanence, the B content is preferably from 0.8 to 1.2 mass %, more preferably from 0.9 to 1.1 mass % In addition to these elements, the R—X—B-based alloy may contain at least one element, such as Al, Si, Ti, V, Cr, Mn, Ni, Cu, Zn, Zr, Nb, Mo, In, Ga, Sn, Hf, Ta and W, because such an element when intervenes in an appropriate amount in the grain boundary phase is likely to contribute to the uniformization of the grains or enhancement of the coercive force.

From the standpoint of, for example, obtaining the above-described effects while suppressing reduction of the remanence, the content of such an element is preferably 3.0 mass % or less, more preferably 1.5 mass % or less.

On the other hand, the RH alloy preferably contains, as a secondary alloy element, at least one element selected from the group consisting of Cu, Al, Ga, Ge, Sn, In, Si, Ag, Au, Pd, Co, Fe, Ni, Cr and Mn. When such a secondary alloy element is contained, this produces the following advantages. That is, this secondary alloy element forms a eutectic crystal with the element RH and the melting point of the RH alloy containing such a secondary alloy element becomes low compared with that of an RH metal alone. For example, although the melting point of the Dy metal alone is about 1,412° C., the eutectic melting point of the 85% Dy-15% Cu (% by mass) alloy becomes about 790° C. and this melting point drop is useful for performing the diffusion treatment of element RH such as Dy at a low temperature. As a result, internal diffusion of the element RH can be performed at a lower temperature and growth of the grains is likely to be suppressed, which can contribute to the elevation of coercive force. Furthermore, a part of the RH alloy is converted into a liquid phase during hot molding, and this is effective also for densification of the magnet compact or enhancement of the plastic workability. Also, the RH metal alone is poor in the pulverizability and a powder having a diameter of several tens of μm is very difficult to obtain, but formation of a eutectic crystal with the above-described secondary alloy element facilitates the pulverization of the RH alloy, that is required, for example, when mixing it with the R—X—B alloy powder.

In the case where the RH alloy contains, as the secondary alloy element, at least one element selected from the group consisting of Cu, Al, Ga, Ge, Sn, In, Si, Ag, Au and Pd, since the melting point of each of these metals alone is relatively low compared with that of the RH alloy containing no such secondary alloy element, this is advantageous, for example, in that the eutectic temperature is liable to become low. In view of low melting point as well as material cost and the like, the RH alloy more preferably contains, as the secondary alloy element, at least one element selected from the group consisting of Cu, Al, Ga, Ge and Sn, and from the same standpoints, still more preferably contains Cu or Al or contains at least Cu and/or Al, such as a combination containing Cu and/or Al.

In the case where the RH alloy contains, as the secondary alloy element, at least one element selected from the group consisting of Co, Fe, Ni, Cr and Mn, this is advantageous particularly, for example, in that the magnet compact is hardly cracked and easily drawn at the plastic working and exhibits excellent magnetic characteristics. It is more preferred to contain Co or Fe or contain at least Co and/or Fe such as a combination containing Co and/or Fe, because, for example, the melting temperature drop is large, which is advantageous in accelerating diffusion of the element RH, and even if partially substituted in the grains, a magnetically adverse effect is hardly caused.

The raw material powder can be specifically prepared, for example, as follows. Incidentally, the raw material powder may be produced or may be supplied from others. The case of producing the raw material powder is described below.

First, an R—X—B-based alloy powder is prepared. As regards the production process of an R—X—B-based alloy powder, for example, an R—X—B-based alloy having a predetermined component composition, such as Nd—Fe—B-based alloy, Pr—Fe—Co—B-based alloy, Pr—Fe—B-based alloy or Pr—Nd—Fe—Co—B-based alloy, is melted at a temperature in accordance with the alloy composition, and the melt is projected from an orifice on a rotating roll with high heat removability (e.g., copper-made rotating roll) and super-quenched (for example, cooled at a rotating roll peripheral velocity of 10 to 30 m/sec), whereby a flake-like powder having a length of several tens of mm and a thickness of approximately from 20 to 50 μm, with the inside being composed of fine grains of approximately from 10 to 20 nm and partially an amorphous phase, is obtained. Then, when this flake-like powder is pulverized using an impact jet mill or the like and, if desired, sieved until the long side becomes about 300 μm or less, an R—X—B-based alloy powder can be obtained. The thus-produced R—X—B-based alloy powder (super-quenched powder) is a magnetically isotropic powder.

Other examples of the production process for an R—X—B-based alloy powder include a method of allowing an ingot obtained by melt-casting an R—X—B-based alloy having the above-described predetermined component composition to store and release hydrogen at a high temperature of around 800° C., thereby obtaining an R—X—B-based alloy powder. According to this method, an ingot is subjected to storage and release of hydrogen at a high temperature, whereby the ingot is pulverized to about several hundreds of μm and at the same time, a powder having a crystalline structure of fine recrystallized grains with a size of several hundreds of nm being deposited by aligning their azimuths is obtained. The thus-produced R—X—B-based alloy powder (so-called HDDR powder) is a powder having magnetic anisotropy.

Next, an RH metal and/or an RH alloy are prepared. Examples of the method for producing such a powder include the above-described super-quenching method, an atomizing method, a casting method and an in-gas evaporation method. For example, in the atomizing method, an RH metal melt or RH alloy melt is atomized in a gas or water or atomized on a rotating disc, whereby a powder with a size of approximately from several tens to a hundred and several tens of μm can be produced. Also, according to the in-gas evaporation method, although the productivity is not excellent, a fine powder with a size of several tens of nm can be produced. Furthermore, an RE metal or RE alloy obtained by a casting method using a general mold or a casting method by strip casting may be subjected to various wet or dry pulverization processes to produce a fine powder of several tens of nm.

Subsequently, the R—X—B-based alloy powder and the RH metal powder and/or RH alloy powder are mixed to prepare a raw material powder.

The mixing method may be either a dry system or a wet system. Specific examples of the mixing method include a method of dry mixing the powders by using a rocking mixer or the like in the atmosphere or in an inert gas atmosphere such as nitrogen or argon, and a method of wet mixing the powders in an organic solvent such as hexane.

Incidentally, even when each powder is more finely pulverized by the mixing, this does not have a significant effect on the later cold molding, and an RH metal powder or RH alloy powder of approximately from 10 to 100 μm is rather advantageous for the later thermal diffusion. Of course, excessive pulverization of the RH metal powder or RH alloy powder to about 1 μm is preferably avoided in view of oxidation inhibition, combustion inhibition or the like.

Other than the mixing above, the RH metal and/or RH alloy may be coated on the R—X—B-based alloy powder to prepare a raw material powder.

As regards the coating method, for example, the R—X—B-based alloy powder and the RH metal piece or RH alloy piece are heat-treated at 800 to 900° C. while rotating these in a high vacuum, whereby an R—X—B-based alloy powder having coated thereon an RH metal or RH alloy can be obtained. This coated powder when used enables omitting the next mixing step and has the advantage over the raw material powder prepared by the mixing method in that the element RH can be more uniformly diffused in the hot molding or heat treatment. Other examples include a method of dispersing the RH metal powder or RH alloy powder in an organic solvent having a low water content and spraying the resulting dispersion on the surface of the R—X—B-based alloy powder. Furthermore, the RH metal or RH alloy may be coated on the R—X—B-based alloy powder by using a technique such as vapor deposition or CVD.

In the raw material powder, for example, from the standpoint of suppressing the reduction of remanence and making it easy to effectively enhance the coercive force, the ratio of the RH metal and/or RH alloy occupying in the raw material powder is preferably from 0.01 to 10 mass %, more preferably from 0.02 to 6 mass %, still more preferably from 0.05 to 3 mass %.

Step (2):

The step (2) is a step of cold molding the prepared raw material powder to obtain a cold compact.

More specifically, the raw material powder is filled in a cold press mold and formed into a cold compact having various shapes such as cylindrical, columnar or plate-like.

In this step, it may be fundamentally sufficient if the raw material powder can be solidified. In view of the strength during handling, the pressure of press, the life of mold, and the like, the real density of the cold compact is preferably from 40 to 70%, more preferably from 50 to 70%.

The compression molding pressure at the cold molding is, for example, approximately from 2 to 4 ton/cm$^2$, and the pressure holding time is, for example, approximately from 1 to 10 seconds.

Here, in the case of using a raw material powder containing an R—X—B-based alloy powder having magnetic isotropy, a cold compact may be formed fundamentally by the above-described procedure.

On the other hand, in the case of using a raw material powder containing an R—X—B-based alloy powder (HDDR powder) having magnetic anisotropy, a magnetically anisotropic cold compact may be formed by further applying a magnetic field such as direct magnetic field or pulsed magnetic field during the cold molding, thereby orienting the R—X—B-based alloy powder in the mold. If the case is so, the later-described hot plastic working for imparting magnetic anisotropy need not be performed and, for example, this can advantageously contribute to enhancement of the productivity by process simplification or the like.

Step (3):

The step (3) is a step of hot molding the obtained cold compact to obtain a hot compact or subjecting the obtained hot compact further to hot plastic working to obtain a hot plastic worked body.

As described above, in the case of using a raw material powder containing an R—X—B-based alloy powder having magnetic isotropy, the cold compact obtained in the step (2) is hot molded, and the obtained hot compact is subjected to hot plastic working to obtain a hot plastic worked body (rare earth magnet). In the case of using a raw material powder containing an R—X—B-based alloy powder (HDDR powder) having magnetic anisotropy, the cold compact obtained in the step (2) is hot molded to obtain a hot compact (rare earth magnet).

As for the hold molding, hot pressing may be suitably employed. Also, SPS (spark plasma sintering) or the like of accelerating the densification by applying heat, pressure and further a high current may be employed. Incidentally, the hot molding and the hot plastic working may be separately performed using separate devices such as press, or these two steps may be continuously performed using one device such as press.

In the hot pressing, the cold compact may be, for example, pressurized and densified within a heated mold in an inert gas atmosphere such as argon, in a vacuum or in the atmosphere.

At this time, in view of, for example, the balance between densification and grain growth inhibiting effect and the diffusibility of element RH, the heating temperature is preferably from 500 to 900° C., more preferably from 700 to 900° C.

Also, the compression molding pressure during hot molding is, for example, approximately from 2 to 4 ton/cm$^2$, and the pressure holding time is, for example, approximately from 5 to 30 seconds.

From the standpoint of, for example, in the case of an isotropic hot compact, preventing crazing or cracking during hold plastic working in the next step or in the case of an anisotropic hot compact, enhancing the remanence by the elevation of density, the density of the hot compact alter hot molding is preferably from 97 to 100%, more preferably from 98 to 100%, still more preferably from 99.5 to 100%, of the theoretical density.

Specific examples of the hot plastic working include hot extrusion, hot drawing, hot forging and hot rolling. These may be performed individually or in combination of two or more. In the case of forming into a cylindrical or plate-like shape, an extrusion method may be suitably used in view of, for example, the orientation characteristic of grains or the material yield.

In the hot plastic working, for example, the hot compact is plastic-deformed by heating in an inert gas atmosphere such as argon, in a vacuum or in the atmosphere. By the plastic deformation, the C axis of the $R_2X_{14}B$ crystal is oriented in the direction to which the stress is applied, whereby an anisotropic magnet is obtained.

At this time, in view of, for example, the balance between grain growth inhibiting effect and plastic deformation and the diffusibility of element RH, the lower limit of the heating temperature is preferably 500° C. or more, more preferably 700° C. or more, still more preferably 750° C. or more. On the other hand, the upper limit of the heating temperature is preferably 900° C. or less, more preferably 850° C. or less.

The production process of the invention fundamentally includes the above-described steps (1) to (3). The production process of the invention may further include the following step (4). In the case of including the step (4), the coercive force is likely to be enhanced by virtue of the progress of diffusion of the element RH.

Step (4):

The step (4) is a step of subjecting the hot compact or hot plastic worked body to a heat treatment.

In the previous hot molding or hot plastic working, the element RH mixed preferentially diffuses into the grain boundary phase, but the hot molding time or hot plastic working time is relatively short in many cases. Accordingly, when the hot compact or hot plastic worked body is heat-treated, diffusion of the element RH into the grain boundary phase can be accelerated. Also, in the case of cutting the rare earth magnet after the heat treatment to obtain a plurality of magnets, for example, magnets having the same performance are advantageously liable to be obtained.

In the case of performing hot plastic working after hot molding, the heat treatment may be applied to the hot plastic worked body.

Here, the temperature of the heat treatment above is preferably from 500 to 900° C., more preferably from 700 to 900° C., still more preferably from 750 to 900° C. The heat treatment time may be appropriately adjusted according to the heat treatment temperature and is preferably from 10 minutes to 12 hours, more preferably from 30 minutes to 6 hours, still more preferably from 30 minutes to 3 hours.

When the heat treatment temperature and heat treatment time are in the ranges above, it becomes easy not only to sufficiently diffuse the element RH into the grain boundary phase but also to cause the majority of the element RH to stay in the grain boundary phase, thereby suppressing substitution with the element R in the grains and restraining reduction of the remanence. Also, the grains are prevented from coarsening and a high coercive force is likely to be obtained.

In the heat treatment, from the standpoint of suppressing reduction of the coercive force, the temperature and the time are preferably adjusted such that the average grain size of the grains becomes 1 μm or less.

Also, in the heat treatment, a higher heat treatment temperature and a shorter heat treatment time are preferred in view of enhancing the productivity. Accordingly, when the heat treatment temperature is from 800 to 900° C., the heat treatment time is preferably from 10 minutes to 2 hours, and when the heat treatment temperature is from 500 to 700° C., the heat treatment time is preferably from 3 to 12 hours.

Incidentally, in view of oxidation inhibition, the heat treatment is preferably performed, for example, in an inert gas atmosphere such as argon or in a vacuum.

EXAMPLES

The present invention is described in greater detail below by referring to Examples.

1. Experiment 1

(Preparation of Raw Material Powder)

Figure 2:
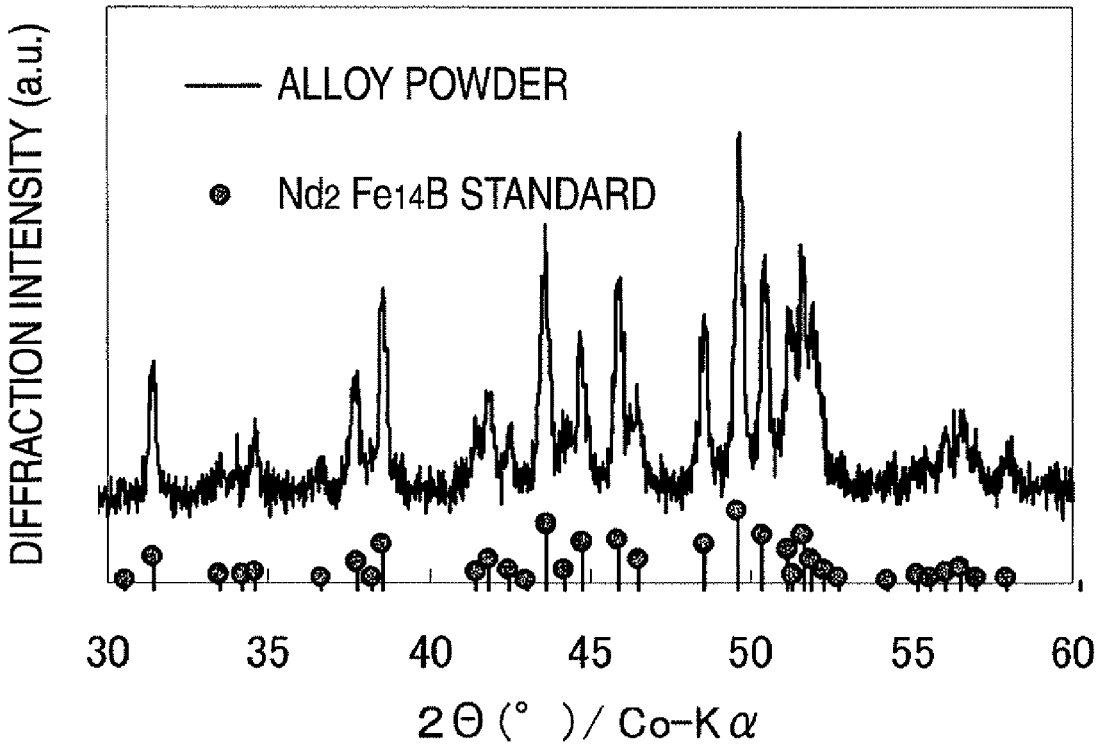
FIG. 2 shows a X-ray diffraction pattern of Rare Earth Alloy Powder A prepared in Experiment 1.

A rare earth alloy having a component composition of, in terms of mass %, 30% Nd-2% Co-1% B-bal. Fe was melted at 1,350° C., and the melt was projected from an orifice on a Cu-made rotating roll plated with Cr (rotating roll peripheral velocity: 20 m/sec) to obtain a rapid-quenched alloy flake. This rapid-quenched alloy flake was pulverized by a cutter mill and sieved to produce a rare earth alloy powder having a maximum particle diameter of 350 μm or less (hereinafter, sometimes referred to as "Rare Earth Alloy Powder A"). The fracture surface of Rare Earth Alloy Powder A was observed using a Scanning electron microscope (SEM) at a magnification of 20,000. As a result, as shown in FIG. 1, it was confirmed that Rare Earth Alloy Powder A is composed of fine grains having a size of about 0.1 μm. In addition, according to the X-ray diffraction measurement using Kα-ray source of Co, it was confirmed that these grains are $Nd_2(Fe,Co)_{14}B$ compound as shown in FIG. 2.

Furthermore, a Dy metal was high-frequency melted, and the melt was atomized by a centrifugal atomization method to obtain a Dy metal powder having a particle size distribution of 30 to 100 μm. Also, by the same procedure as in the production of the Dy metal powder, a 85Dy-15Cu alloy powder having a component composition of, in terms of mass %, 85% Dy-15% Cu was produced (hereinafter, the explanation of the component composition is sometimes omitted, but, for example, the expression "aX-bY-cZ" means to contain a mass % of X, b mass % of Y, and c mass % of Z).

As shown in Table 1 later, from 0.3 to 1.1 mass % of the Dy metal powder or 85Dy-15Cu alloy powder was added to. Rare Earth Alloy Powder A and mixed using a coffee mill in the atmosphere. In this way, respective raw material powders for use in the production of the rare earth magnets of Examples 1 to 6 were prepared.

On the other hand, by the same procedure as in the production of Rare Earth Alloy Powder A, a rare earth powder having a component composition of, in terms of mass %, 29% Nd-1% Dy-2% Co-1% B-bal. Fe (a powder where Dy was previously added at the melting of rapid-quenched alloy) was prepared (hereinafter sometimes referred to as "Rare Earth Alloy Powder B").

Incidentally, in the production of the rare earth magnet of Comparative Example 1, Rare Earth Alloy Powder A was used directly, and in the production of the rare earth magnet of Comparative Example 2, Rare Earth Alloy Powder B was used directly.

(Cold Molding)

55 Grams of each raw material powder, Rare Earth Alloy Powder A or Rare Earth Alloy Powder B was loaded into a cold press mold and formed by applying a pressure of 3 ton/cm$^2$ to produce a cylindrical cold compact (outside diameter: 23 mm, inside diameter: 14 mm, height: 30 mm).

(Hot Molding)

The cold compact was set in a hot press mold and formed by heating the mold at 800° C. in an argon atmosphere and applying a pressure of 3 ton/cm$^2$ for about 15 seconds to produce a densified cylindrical hot compact having a height of about 20 mm.

(Hot Plastic Working)

The hot compact was set in a mold of backward extrusion equipment and backward extruded by heating the mold at 850° C. in the atmosphere to obtain a hot plastic worked body deformed in terms of the inside diameter and height (outer diameter: 23 mm, inner diameter: 18 mm, height: 40 mm), and the unextruded bottom portion was cut off. In this way, a cylindrical rare earth magnet having magnetic anisotropy in the radial direction was produced.

(Microstructure of Rare Earth Magnet)

Figure 3:
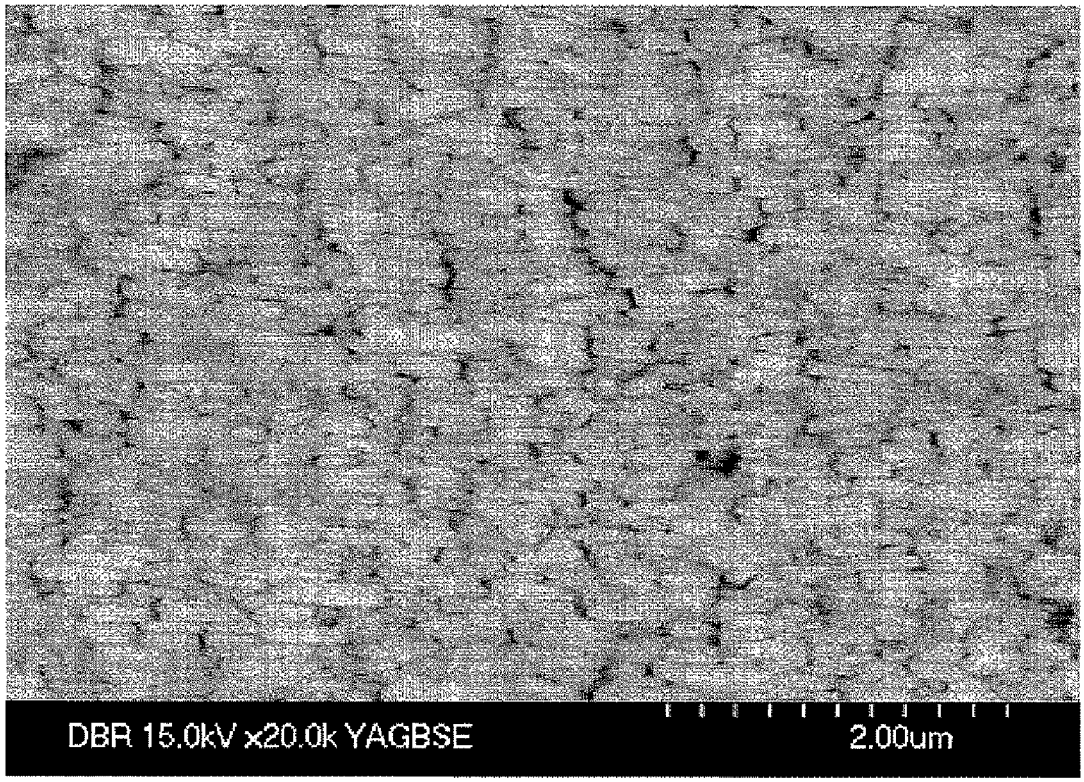
FIG. 3 shows a photograph of crystalline structure of sample of Example 5, taken using a scanning electron microscope (SEM).
Figure 4:
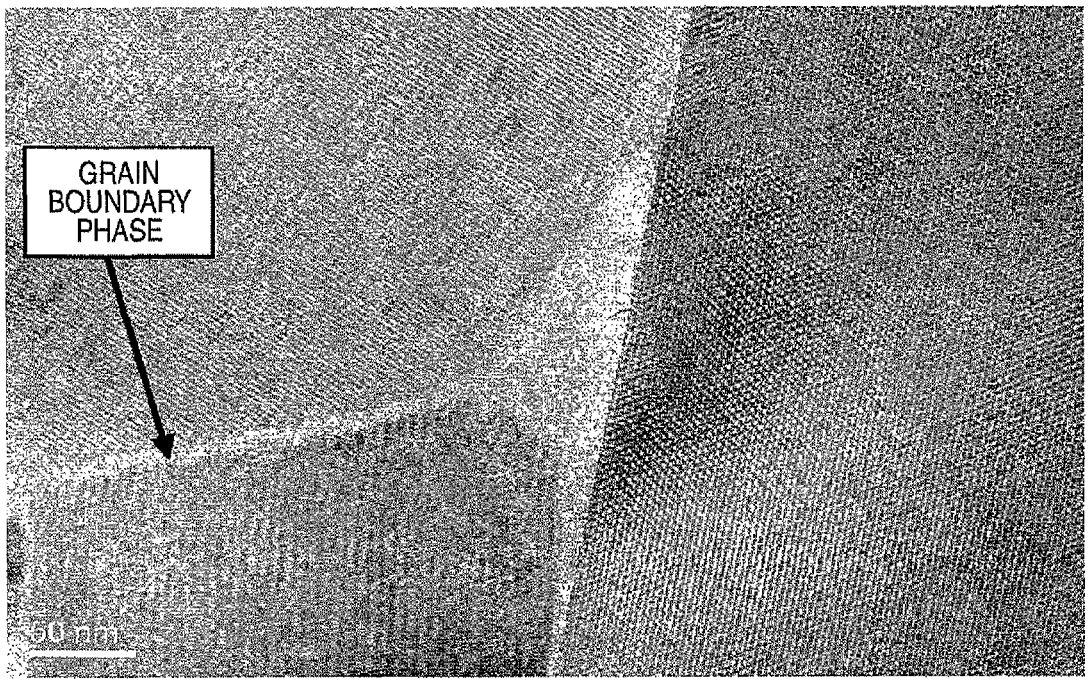
FIG. 4 shows a photograph of crystalline structure of sample of Example 5, taken using a transmission electron microscope (TEM).

A specimen was cut out from each of the rare earth magnets of Examples 1 to 6 and embedded in a resin and after polishing and etching, the specimen was observed by a scanning electron microscope (SEM). According to the measurement for sample of Example 5, as shown in FIG. 3, a lot of plate-like grains in which the C axes of $Nd_2(Fe,Co)_{14}B$ crystals are aligned in the vertical direction of the photograph were observed. The size of the crystals was such that the thickness was 0.05 to 0.1 μm and the length was 0.2 to 0.6 μm. In addition, according to the measurement of microstructure using transmission electron microscopy (TEM), as shown in FIG. 4, it was confirmed that a grain boundary phase having a thickness of about several to 10 nm surrounded the peripheries of the main grains (in FIG. 4, white-lined scale indicates 50 nm).

Also, an image of each structure was photographed and the grain size was determined. At this time, the calculation of the grain size was performed by drawing several straight lines in an image when the C plane of the rare earth magnet was photographed (magnification: 10,000 times), measuring the lengths of 50 pieces of grains in total, and determining the average of the lengths measured.

In addition, the concentration of the rare earth element in the grains and the grain boundary phase was examined using an EDX analyzer attached to SEM, as a result, the magnet of Comparative Example 1 was confirmed to contain grains including an $Nd_2Fe_{14}B$ phase as the main phase and be rich in Nd in the grain boundary phase. Also, the magnet of Example 1 was confirmed to contain grains including an $Nd_2Fe_{14}B$ phase as the main phase and be richer in Dy in the grain boundary phase than in the grains.

As for the rare earth magnet of Example 3 (containing 1 mass % of a Dy metal powder), EDX analysis was further performed at the magnet surface part, the magnet central part and the intermediate part thereof (region of 10 μm×10 μm), and the concentration of element Dy was measured for each region. In this regard, as the concentration of element Dy at the magnet surface part, the concentration of element Dy at the part which is at a depth of 10 μm from the outermost surface of the cylindrical magnet was measured. As the concentration of element Dy at the magnet central part, the concentration of element Dy at the part corresponding to the average of the inner diameter and outer diameter of the cylindrical magnet was measured. As the concentration of element Dy at the intermediate part, the concentration of element Dy at the part intermediate between the magnet surface part and the magnet central part was measured. As a result, the concentration of element Dy was 0.94% at the magnet surface part, 0.92% at the magnet intermediate part, and 0.93% at the magnet central part. Namely, the concentration difference of the element RH in the depth direction from the surface part of the magnet to the inside of the magnet was 2.1%. Consequently, it was seen that the rare earth magnet according to the invention is extremely excellent in uniformity of concentration of element Dy over the entire magnet, in comparison with conventional gradient sintered magnet (see, data of parts distant at 10 μm or 500 μm from the surface described in Table 1 of JP-A-2006-303436).

These results confirm that the element Dy is concentrated in the grain boundary phase and at the same time, the element Dy is present with an almost constant concentration distribution from the surface part of the magnet to the central part of the magnet That is, it is revealed that according to the present invention, the Dy concentration inside of the magnet is distinctly homogeneous (the concentration difference among respective regions is about 10% or less) compared with the method of causing an element Dy to diffuse and penetrate from the magnet surface (for example, a functionally gradient magnet described in JP-A-2006-303436). Incidentally, it is easy to infer from the Dy concentration distribution results of Example 3 that also in other Examples, the element Dy is similarly distributed in the grain boundary phase.

(Measurement of Magnetic Characteristics)

An arced magnet piece (4 (height)×4 (width)×2.5 (thickness) mm) obtained by cutting each of the cylindrical rare earth magnets produced above into 4 mm in the height direction and further circumferentially dividing it into 16 parts was measured for the magnetism by using a vibrating sample magnetometer (VSM), and the coercive force (Hcj) and remanence (Br) were determined by performing a demagnetizing field correction.

Various conditions and results of Experiment 1 are shown together in Table 1.

Hcj compared with others. This is caused because the magnet is produced using Rare Earth Alloy Powder A alone without mixing a Dy metal powder or 85Dy-15Cu alloy powder with Rare Earth Alloy Powder A.

In the rare earth magnet of Comparative Example 2, the coercive force Hcj is increased but reduction of the remanence Br is large. This is considered to occur because the coercive force Hcj can be increased by virtue of addition of Dy at the melting of the rapid-quenched alloy but the remanence is decreased due to magnetically antiparallel coupling between Dy and Fe atoms.

On the other hand, it is seen that the rare earth magnets of Examples 1 to 3 exhibit small reduction of the remanence Br and large increase of the coercive force Hcj as compared with the rare earth magnet of Comparative Example 1. This is considered to result because diffusion of the element Dy into the grain boundary phase inside of the magnet is made uniform while passing the raw material powder through cold molding, hot molding and hot plastic working and the coercive force Hcj can be efficiently increased.

In the rare earth magnets of Examples 4 to 6, increase of the coercive force Hcj is large compared with the rare earth magnets of Examples 1 to 3. This is considered to result because Dy is more readily allowed to diffuse and penetrate into the grain boundary phase when using a Dy—Cu alloy having a melting point of 790° C. at the hot molding rather than using a Dy metal having a melting point of 1,142° C.

Also, it is seen that in the rare earth magnets of Examples 1 to 6, as the mixing amount of the Dy metal or Dy—Cu alloy mixed with the rare earth alloy powder is increased (as the Dy content increases), the coercive force Hcj becomes higher.

2. Experiment 2

(Heat Treatment)

With respect to the rare earth magnets of Examples 1 and 4 produced in Experiment 1 (Example 1: the mixing amount of Dy metal powder is 0.3 mass %; Example 4: the mixing amount of 85Dy-15Cu alloy powder is 0.3 mass %), the arced magnet piece was loaded into a vacuum heat treatment furnace and heat-treated at 500 to 1,000° C. for 30 minutes in an Ar atmosphere. Then, the grain size and magnetic characteristics were measured in the same manner as in Experiment 1. In this regard, Example 15 after the heat treatment was observed using a scanning electron microscopy (SEM) in the same manner as Example 5. As a result, a microstructure including a lot of plate-like grains and a grain boundary phase surrounding the peripheries thereof was observed. In addi-

TABLE 1

| | Raw Material Powder | | | | Hcj | |
|---|---|---|---|---|---|---|
| | R—X—B-Based | RH Metal or RH Alloy | | | (Coercive | Br |
| | Alloy Powder Composition (mass %) | Composition (mass %) | Mixing Amount (mass %) | Grain Size (nm) | Force) (kA/m) | (Remanence) (T) |
| Example 1 | A 30Nd—2Co—1B-bal.Fe | Dy | 0.3 | 265 | 1620 | 1.42 |
| Example 2 | A 30Nd—2Co—1B-bal.Fe | Dy | 0.6 | 274 | 1690 | 1.41 |
| Example 3 | A 30Nd—2Co—1B-bal.Fe | Dy | 1 | 249 | 1750 | 1.39 |
| Example 4 | A 30Nd—2Co—1B-bal.Fe | 85Dy—15Cu | 0.3 | 287 | 1710 | 1.43 |
| Example 5 | A 30Nd—2Co—1B-bal.Fe | 85Dy—15Cu | 0.7 | 297 | 1800 | 1.41 |
| Example 6 | A 30Nd—2Co—1B-bal.Fe | 85Dy—15Cu | 1.1 | 316 | 1870 | 1.39 |
| Comparative Example 1 | A 30Nd—2Co—1B-bal.Fe | — | — | 237 | 1460 | 1.44 |
| Comparative Example 2 | B 29Nd—1Dy—2Co—1B-bal.Fe | — | — | 256 | 1690 | 1.35 |

Table 1 reveals the followings. That is, the rare earth magnet of Comparative Example 1 is small in the coercive force tion, as a result of measurement using a transmission electron microscopy (TEM), it was confirmed that diffusion of element Dy into the grain boundary phase is promoted in Example 15 in comparison with the case of Example 5.

Various conditions and results of Experiment 2 are shown together in Table 2.

TABLE 2

| | Raw Material Powder | | | | | | |
|---|---|---|---|---|---|---|---|
| | R—X—B-Based | RH Metal or RH Alloy | | | | Hcj | |
| | Alloy Powder Composition (mass %) | Composition (mass %) | Mixing Amount (mass %) | Heat Treatment Conditions | Grain Size (nm) | (Coercive Force) (kA/m) | Br (Remanence) (T) |
| Example 7 | A 30Nd—2Co—1B-bal.Fe | Dy | 0.3 | 500° C. × 30 min | 241 | 1640 | 1.42 |
| Example 8 | A 30Nd—2Co—1B-bal.Fe | Dy | 0.3 | 600° C. × 30 min | 286 | 1680 | 1.42 |
| Example 9 | A 30Nd—2Co—1B-bal.Fe | Dy | 0.3 | 700° C. × 30 min | 387 | 1760 | 1.41 |
| Example 10 | A 30Nd—2Co—1B-bal.Fe | Dy | 0.3 | 800° C. × 30 min | 421 | 1812 | 1.42 |
| Example 11 | A 30Nd—2Co—1B-bal.Fe | Dy | 0.3 | 900° C. × 30 min | 788 | 1803 | 1.41 |
| Example 12 | A 30Nd—2Co—1B-bal.Fe | Dy | 0.3 | 1000° C. × 30 min | 1440 | 1784 | 1.37 |
| Example 13 | A 30Nd—2Co—1B-bal.Fe | 85Dy—15Cu | 0.3 | 600° C. × 30 min | 302 | 1760 | 1.43 |
| Example 14 | A 30Nd—2Co—1B-bal.Fe | 85Dy—15Cu | 0.3 | 700° C. × 30 min | 405 | 1850 | 1.42 |
| Example 15 | A 30Nd—2Co—1B-bal.Fe | 85Dy—15Cu | 0.3 | 800° C. × 30 min | 511 | 1890 | 1.42 |
| Comparative Example 1 | A 30Nd—2Co—1B-bal.Fe | — | — | — | 237 | 1460 | 1.44 |

Table 2 reveals the followings. That is, when a heat treatment is added, the remanence Br is scarcely changed and the coercive force Hcj is further increased. This is considered to occur because diffusion of the element Dy into the grain boundary phase is accelerated by the heat treatment and the element Dy can be internally diffused more homogeneously into the grain boundary phase.

Also, when the temperature at the heat treatment is from 500 to 900° C., an excellent balance is obtained between the remanence Br and the coercive force Hcj. This is considered to result because, for example, the element Dy is sufficiently diffused into the grain boundary phase, the majority of the element Dy is caused to stay in the grain boundary phase, thereby suppressing substitution with the element Nd in the grains and restraining reduction of the remanence, the grains are prevented from coarsening, and a high coercive force can be in turn obtained.

Also, it is seen that in Examples 13 to 15 using a Dy—Cu alloy powder, the coercive force Hcj is larger but the increase rate of the coercive force Hcj is smaller than in Examples 7 to 12 using a Dy metal powder. This is considered to result because the melting point of the Dy—Cu alloy is low and therefore, diffusion of Dy had proceeded during previous hot molding.

3. Experiment 3

(Preparation of Raw Material Powder)

Two kinds of rare earth alloy powders C and D (maximum particle diameter: 350 μm or less) having a component composition of, in terms of mass %, 29% Pr-1% Co-1% B-bal. Fe or 25% Pr-3% Nd-2% Dy-1% B-bal. Fe were produced under the same conditions as in Experiment 1. Also, a 85Dy-15Cu alloy powder (maximum particle diameter: 350 μm or less) was produced by a quenching method using a rotating roll and subjected to pulverization and sieving, whereby a powder having a maximum grain size of 74 μm or less was obtained.

As shown in Table 3 later, from 0.2 to 3 mass % of 85Dy-15Cu alloy powder was added to Rare Earth Alloy Powder C or D and mixed using a coffee mill in the atmosphere. In this way, respective raw material powders for use in the production of the rare earth magnets of Examples 16 to 25 were prepared.

Incidentally, in the production of the rare earth magnet of Comparative Example 3, Rare Earth Alloy Powder C was used directly, and in the production of the rare earth magnet of Comparative Example 4, Rare Earth Alloy Powder D was used directly.

(Cold Molding→Hot Molding→Hot Plastic Working→Heat Treatment)

As for the subsequent processes, cold molding, hot molding and hot plastic working were performed in the same manner as in Experiment 1, and a heat treatment was further performed at 750° C. for 1 hour in an Ar atmosphere. Then, the magnetic characteristics were measured in the same manner as in Experiment 1.

Various conditions and results of Experiment 3 are shown together in Table 3.

TABLE 3

| | Raw Material Powder | | | | Hcj | |
|---|---|---|---|---|---|---|
| | R—X—B-Based | RH Metal or RH Alloy | | Heat | (Coercive | Br |
| | Alloy Powder Composition (mass %) | Composition (mass %) | Mixing Amount (mass %) | Treatment Conditions | Force) (kA/m) | (Remanence) (T) |
| Example 16 | C 29Pr—1Co—1B-bal.Fe | 85Dy—15Cu | 0.2 | 750° C. × 1 h | 1800 | 1.42 |
| Example 17 | C 29Pr—1Co—1B-bal.Fe | 85Dy—15Cu | 0.5 | 750° C. × 1 h | 1930 | 1.39 |
| Example 18 | C 29Pr—1Co—1B-bal.Fe | 85Dy—15Cu | 1 | 750° C. × 1 h | 2023 | 1.37 |
| Example 19 | C 29Pr—1Co—1B-bal.Fe | 85Dy—15Cu | 2 | 750° C. × 1 h | 2240 | 1.31 |
| Example 20 | C 29Pr—1Co—1B-bal.Fe | 85Dy—15Cu | 3 | 750° C. × 1 h | 2354 | 1.26 |
| Example 21 | D 25Pr—3Nd—2Dy—1B-bal.Fe | 85Dy—15Cu | 0.2 | 750° C. × 1 h | 2277 | 1.26 |
| Example 22 | D 25Pr—3Nd—2Dy—1B-bal.Fe | 85Dy—15Cu | 0.5 | 750° C. × 1 h | 2380 | 1.23 |
| Example 23 | D 25Pr—3Nd—2Dy—1B-bal.Fe | 85Dy—15Cu | 1 | 750° C. × 1 h | 2450 | 1.19 |

TABLE 3-continued

| | Raw Material Powder | | | | Hcj | |
|---|---|---|---|---|---|---|
| | R—X—B-Based | RH Metal or RH Alloy | | Heat | (Coercive | Br |
| | Alloy Powder Composition (mass %) | Composition (mass %) | Mixing Amount (mass %) | Treatment Conditions | Force) (kA/m) | (Remanence) (T) |
| Example 24 | D 25Pr—3Nd—2Dy—1B-bal.Fe | 85Dy—15Cu | 2 | 750° C. × 1 h | 2550 | 1.13 |
| Example 25 | D 25Pr—3Nd—2Dy—1B-bal.Fe | 85Dy—15Cu | 3 | 750° C. × 1 h | 2720 | 1.08 |
| Comparative Example 3 | C 29Pr—1Co—1B-bal.Fe | — | — | 750° C. × 1 h | 1530 | 1.43 |
| Comparative Example 4 | D 25Pr—3Nd—2Dy—1B-bal.Fe | — | — | 750° C. × 1 h | 2030 | 1.28 |

Table 3 reveals the followings. That is, also in the case of a Pr-based rare earth magnet instead of the Nd-based rare earth magnet, the coercive force Hcj can be increased similarly. Furthermore, as seen from comparison of Example 1 in Table 1 with Example 16 in Table 3, although there are some differences in terms of performing or nonperforming of the heat treatment or mixing amount of the Dy—Cu powder, the coercive force of the Pr-based rare earth magnet is larger than that of the Nd-based rare earth magnet. In addition, even when a Dy-containing alloy is previously used as the R—X—B-based alloy powder, the coercive force Hcj can be increased by mixing a Dy-containing alloy powder as the RH alloy powder.

It is seen that the increase of the coercive force Hcj is large in the rare earth magnets of Examples 16 to 20 and those of Examples 21 to 25 as compared with Comparative Example 3 and Comparative Example 4, respectively. Furthermore, as the mixing amount of the Dy—Cu alloy mixed with the rare earth alloy powder is increased (as the Dy content increases), the coercive force Hcj becomes higher.

4. Experiment 4

(Preparation of Raw Material Powder)

Rare Earth Alloy Powder A' having a component composition of, in terms of mass %, 30% Nd-2% Co-1% B-0.5% Ga-bal. Fe was produced in the same manner as in Experiment 1. Also, Rare Earth Alloy Powder B' having a component composition of, in terms of mass %, 29% Nd-1% Dy-2% Co-1% B-0.5% Ga-bal. Fe was produced. Furthermore, an RH metal powder or RH alloy powder having a composition of various components shown in Table 4 later was produced using a gas atomizer.

Subsequently, various RH metal powders or RH alloy powders weighed to give a mixing amount of 0.25 mass % each was added to Rare Earth Alloy Powder A' and mixed by a ball mill (solvent: cyclohexane) for 10 minutes and after drying the solvent, the powder was collected. In this way, respective raw material powders for use in the production of the rare earth magnets of Examples 26 to 35 were prepared.

Incidentally, in the production of the rare earth magnet of Comparative Example 5, Rare Earth Alloy Powder B' was used directly.

(Cold Molding)

Thirty-three grams of each raw material powder was loaded into a cold press mold and formed by applying a pressure of 5 ton/cm$^2$ to produce a columnar cold compact (outer diameter: 20 mm, height: 20 mm).

(Hot Molding)

The cold compact was set in a hot press mold and formed by heating the mold at 820° C. in an argon atmosphere and applying a pressure of 3 ton/cm$^2$ for about 10 seconds to produce a columnar hot compact having a height of about 14 mm and being densified to a density of 99%.

(Hot Plastic Working)

The hot compact was set in a press mold and compression deformed by heating the mold at 820° C. in an Ar atmosphere to produce a discotic hot plastic worked body (outer diameter: 32 mm, height: 5.5 mm).

(Heat Treatment)

The hot plastic worked body was cut into a size of 4 mm×4 mm×4 mm by using a wire electric discharge machine and heat-treated at 800° C. for 10 minutes in a vacuum. Then, the magnetic characteristics were measured in the same manner as in Experiment 1.

Various conditions and results of Experiment 4 are shown together in Table 4.

TABLE 4

| | Raw Material Powder | | | | Hcj | |
|---|---|---|---|---|---|---|
| | | RH Metal or RH Alloy | | | | |
| | R—X—B-Based Alloy Powder Composition (mass %) | Composition (mass %) | Mixing Amount (mass %) | Heat Treatment Conditions | (Coercive Force) (kA/m) | Br (Remanence) (T) |
| Example 26 | A' 30Nd—2Co—1B—0.5Ga-bal.Fe | Dy | 0.25 | 800° C. × 10 min | 1630 | 1.43 |
| Example 27 | A' 30Nd—2Co—1B—0.5Ga-bal.Fe | 85Dy—15Cu | 0.25 | 800° C. × 10 min | 1670 | 1.42 |
| Example 28 | A' 30Nd—2Co—1B—0.5Ga-bal.Fe | 87Dy—13Fe | 0.25 | 800° C. × 10 min | 1540 | 1.42 |
| Example 29 | A' 30Nd—2Co—1B—0.5Ga-bal.Fe | 80Dy—20Ge | 0.25 | 800° C. × 10 min | 1610 | 1.41 |
| Example 30 | A' 30Nd—2Co—1B—0.5Ga-bal.Fe | 70Dy—30Ga | 0.25 | 800° C. × 10 min | 1720 | 1.43 |
| Example 31 | A' 30Nd—2Co—1B—0.5Ga-bal.Fe | 75Dy—25Pr | 0.25 | 800° C. × 10 min | 1590 | 1.40 |
| Example 32 | A' 30Nd—2Co—1B—0.5Ga-bal.Fe | 80Dy—13Cu—10Al | 0.25 | 800° C. × 10 min | 1730 | 1.42 |
| Example 33 | A' 30Nd—2Co—1B—0.5Ga-bal.Fe | Tb | 0.25 | 800° C. × 10 min | 1860 | 1.39 |
| Example 34 | A' 30Nd—2Co—1B—0.5Ga-bal.Fe | 85Tb—15Cu | 0.25 | 800° C. × 10 min | 1990 | 1.40 |

TABLE 4-continued

| | Raw Material Powder | | | | | | |
|---|---|---|---|---|---|---|---|
| | | | RH Metal or RH Alloy | | | Hcj | |
| | | R—X—B-Based Alloy Powder Composition (mass %) | Composition (mass %) | Mixing Amount (mass %) | Heat Treatment Conditions | (Coercive Force) (kA/m) | Br (Remanence) (T) |
| Example 35 | A' | 30Nd—2Co—1B—0.5Ga-bal.Fe | 75Tb—15Cu—10Ga | 0.25 | 800° C. × 10 min | 1950 | 1.40 |
| Comparative Example 5 | B' | 29Nd—1Dy—2Co—1B—0.5Ga-bal.Fe | — | — | — | 1460 | 1.44 |

Table 4 mainly reveals the followings. That is, although the mixing amount is relatively small of 0.25 mass %, in either case of using a Dy-based (Examples 26 to 32) or Tb-based (Examples 33 to 35) RH metal powder or RH alloy powder, the coercive force Hcj is increased.

It is also seen that the coercive force Hcj can be increased by using a Dy-based alloy or a Tb-based alloy rather than using a pure Dy metal or a pure Tb metal. This is considered to result because when such an alloy forms an eutectic alloy, its melting point decreases and the effect of accelerating diffusion into the grain boundary phase is raised by the heat treatment.

Furthermore, the increase of the coercive force Hcj is larger when using a Tb-based alloy than when using a Dy-based alloy. This is attributable to the fact that the crystal magnetic anisotropy of Tb is larger than that of Dy.

In addition, it is seen that the coercive force Hcj and the remanence Br can be adjusted by appropriately selecting the additive element of the RH alloy.

5. Experiment 5

(Preparation of Raw Material Powder)

An ingot was produced by melt-casting a rare earth alloy having a component composition of, in terms of mass %, 31% Nd-2% Co-1% B-0.3% Ga-bal. Fe, and this ingot was loaded into a vacuum furnace. After evacuation, a hydrogen gas was supplied in the process of raising the temperature from room temperature to 820° C. to allow hydrogen to be stored in the alloy ingot, and then the hydrogen was released by means of evacuation. The ingot collapsed through this treatment was pulverized using a stamp mill to produce HDDR Powder E having a maximum particle diameter of 105 μm. Also, a 85Dy-15Cu alloy powder was produced in the same manner as in Experiment 1.

Thereafter, the 85Dy-15Cu alloy powder weighed to give a mixing amount of 0.3 mass % was added to HDDR Powder E and mixed using a coffee mill in the atmosphere. In this way, respective raw material powders for use in the production of the rare earth magnets of Examples 36 to 39 were prepared.

Incidentally, in the production of the rare earth magnet of Comparative Example 6, HDDR Powder E was used directly.

(Cold Molding)

Into a cold press mold, 3.4 grams of each raw material powder was loaded and formed by applying a pressure of 1 ton/cm$^2$ while adding a magnetic field of 1,600 kA/m to produce a prismatic cold compact (8 mm×8 mm×12 mm). Here, the cold compacts in Experiments 1 to 4 were magnetically isotropic, but the cold compact in Experiment 5 had magnetic anisotropy, because HDDR Powder E having magnetic anisotropy was used and the cold molding was performed in a magnetic field.

(Hot Molding)

The cold compact was set in a hot press mold and formed by heating the mold at 800° C. in an argon atmosphere and applying a pressure of 3 ton/cm$^2$ for about 10 seconds to produce a prismatic hot compact (8 mm×8 mm×7 mm) compressed in the height direction.

(Heat Treatment)

The hot compact was heat-treated at 600 to 900° C. for 30 minutes in an Ar atmosphere. The samples after cooling were measured for magnetic characteristics by using a BH tracer.

Various conditions and results of Experiment 5 are shown together in Table 5.

TABLE 5

| | Raw Material Powder | | | | | Hcj | |
|---|---|---|---|---|---|---|---|
| | | | RH Metal or RH Alloy | | | (Coercive | Br |
| | | R—X—B-Based Alloy Powder Composition (mass %) | Composition (mass %) | Mixing Amount (mass %) | Heat Treatment Conditions | Force) (kA/m) | (Remanence) (T) |
| Example 36 | E | 31Nd—2Co—1B—0.3Ga-bal.Fe | 85Dy—15Cu | 0.3 | 600° C. × 30 min | 1430 | 1.36 |
| Example 37 | E | 31Nd—2Co—1B—0.3Ga-bal.Fe | 85Dy—15Cu | 0.3 | 700° C. × 30 min | 1480 | 1.35 |
| Example 38 | E | 31Nd—2Co—1B—0.3Ga-bal.Fe | 85Dy—15Cu | 0.3 | 800° C. × 30 min | 1540 | 1.36 |
| Example 39 | E | 31Nd—2Co—1B—0.3Ga-bal.Fe | 85Dy—15Cu | 0.3 | 900° C. × 30 min | 1510 | 1.34 |
| Example 40 | E | 31Nd—2Co—1B—0.3Ga-bal.Fe | 85Dy—15Cu | 0.3 | — | 1410 | 1.35 |
| Comparative Example 6 | E | 31Nd—2Co—1B—0.3Ga-bal.Fe | — | — | — | 1220 | 1.38 |

Table 5 mainly reveals the followings. That is, also when HDDR Powder E by an HDDR method is prepared as the raw material powder, similarly to Experiments 1 to 4, a rare earth magnet exhibiting a high coercive force Hcj while suppressing reduction of the remanence Br is produced. Furthermore, the coercive force Hcj is larger in Examples 36 to 39 where a heat treatment is applied, than in Example 40 where a heat treatment is not applied. This is considered to result because internal diffusion of the element RH into the grain boundary phase can be achieved more homogeneously by virtue of applying a heat treatment.

In addition, in this case, the magnetic anisotropy can be imparted at the cold molding and therefore, the hot plastic working can be omitted, which can contribute to enhancement of productivity, such as simplification of the production process.

6. Experiment 6

(Preparation of Raw Material Powder)

Rare Earth Alloy Powder F (maximum particle diameter: 350 μm or less) having a component composition of, in terms of mass %, 27% Nd-3% Pr-1% B-bal. Fe was produced in the same manner as in Experiment 1. Also, an alloy flake having a component composition of, in terms of mass %, 75% Dy-25% Cu was produced by the same quenching method as above and treated in a wet ball mill using a hexane solvent to produce a 75Dy-25Cu alloy powder having an average particle diameter of 20 μm.

As shown in Table 6 later, from 0.03 to 15 mass % of the 75Dy-25Cu alloy powder was added to Rare Earth Alloy Powder F and mixed with stirring in a hexane solvent, and the mixture was naturally dried. In this way, respective raw material powders for use in the production of the rare earth magnets of Examples 41 to 50 were prepared.

On the other hand, Rare Earth Alloy Powder G having a component composition of, in terms of mass %, 26.61% Nd-3% Pr-0.39% Dy-1% B-bal. Fe, Rare Earth Alloy Powder H having a component composition of, in terms of mass %, 25.5% Nd-3% Pr-1.5% Dy-1% B-bal. Fe, and Rare Earth Alloy Powder I having a component composition of, in terms of mass %, 17.9% Nd-3% Pr-9.1% Dy-1% B-bal. Fe were prepared by the same procedure as in the production of Rare Earth Alloy Powder F. These Rare Earth Alloy Powders G to I were an alloy powder produced by previously adding Dy at the melting of the rapid-quenched alloy.

Incidentally, in the production of the rare earth magnet of Comparative Example 7, Rare Earth Alloy Powder F was used directly.

(Cold Molding→Hot Molding→Hot Plastic Working)

As for the subsequent processes, cold molding, hot molding and hot plastic working were sequentially performed in the same manner as in Experiment 1. In Examples 41 to 50, a heat treatment was further performed at 750° C. for 1 hour in an Ar atmosphere. Incidentally, the heat treatment was omitted in Comparative Examples 7 to 10. Then, the magnetic characteristics were measured in the same manner as in Experiment 1.

Various conditions and results of Experiment 6 are shown together in Table 6.

Table 6 mainly reveals the followings. That is, it is seen from Table 6 that compared with Comparative Example 7 not containing Dy that is the element RH, in Examples 41 to 50, Dy as the element RE is contained and the coercive force Hcj is greatly enhanced along with increase of the Dy content. More specifically, as understood from comparison between Example 41 and Comparative Example 7, when Dy in a very small amount of 0.02 mass % is contained, the effect of enhancing the coercive force is recognized without incurring any change in the remanence Br.

Also, when Example 44 according to the production process of the invention is compared with Comparative Example 8 where Dy is previously added to a rare earth alloy by a conventional melting method, despite almost the same Dy content in the magnet, the coercive force Hcj is larger in Example 44. The same tendency is recognized from comparison between Example 46 and Comparative Example 9 and between Example 49 and Comparative Example 10. These results are considered to be produced because according to the production process of the invention, the element Dy as the element RH is preferentially diffused into the grain boundary phase and at the same time, diffusion of the element Dy into the main grain is suppressed.

7. Experiment 7

(Preparation of Raw Material Powder)

A rare earth alloy having a component composition of, in terms of mass %, 29% Pr-1% B-0.5% Ga-bal. Fe was melted at 1,350° C., and the melt was projected from an orifice on a Cu-made rotating roll plated with Cr (rotating roll peripheral velocity: 20 m/sec) to obtain a rapid-quenched alloy flake. This rapid-quenched alloy flake was pulverized by a cutter mill and sieved to produce Rare Earth Alloy Powder a having a maximum particle diameter of 350 μm or less.

Furthermore, a 80Dy-20Co alloy having a component composition of, in terms of mass %, 80% Dy-20% Co was high-frequency melted, and the melt was atomized by a centrifugal atomization method to obtain a 80Dy-20Co alloy powder having a particle size distribution of 30 to 70 μm.

As shown in Table 7 later, from 0.2 to 6 mass % of the 80Dy-20Co alloy powder was added to Rare Earth Alloy Powder a and wet mixed in a hexane solvent. In this way,

TABLE 6

| | Raw Material Powder | | | | | | |
|---|---|---|---|---|---|---|---|
| | | | RH Metal or RH Alloy | | RH Content | Hcj | Br |
| | | R—X—B-Based Alloy Powder Composition (mass %) | Composition (mass %) | Mixing Amount (mass %) | (Dy Content) (mass %) | (Coercive Force) (kA/m) | (Remanence) (T) |
| Example 41 | F | 27Nd—3Pr—1B-bal.Fe | 75Dy—25Cu | 0.03 | 0.02 | 1440 | 1.41 |
| Example 42 | F | 27Nd—3Pr—1B-bal.Fe | 75Dy—25Cu | 0.05 | 0.04 | 1480 | 1.41 |
| Example 43 | F | 27Nd—3Pr—1B-bal.Fe | 75Dy—25Cu | 0.1 | 0.08 | 1640 | 1.40 |
| Example 44 | F | 27Nd—3Pr—1B-bal.Fe | 75Dy—25Cu | 0.5 | 0.38 | 1840 | 1.40 |
| Example 45 | F | 27Nd—3Pr—1B-bal.Fe | 75Dy—25Cu | 1 | 0.75 | 2000 | 1.39 |
| Example 46 | F | 27Nd—3Pr—1B-bal.Fe | 75Dy—25Cu | 2 | 1.5 | 2160 | 1.37 |
| Example 47 | F | 27Nd—3Pr—1B-bal.Fe | 75Dy—25Cu | 5 | 3.75 | 2440 | 1.33 |
| Example 48 | F | 27Nd—3Pr—1B-bal.Fe | 75Dy—25Cu | 8 | 6 | 2880 | 1.24 |
| Example 49 | F | 27Nd—3Pr—1B-bal.Fe | 75Dy—25Cu | 12 | 9 | 3360 | 1.15 |
| Example 50 | F | 27Nd—3Pr—1B-bal.Fe | 75Dy—25Cu | 15 | 11.25 | 3600 | 1.09 |
| Comparative Example 7 | F | 27Nd—3Pr—1B-bal.Fe | — | — | 0 | 1360 | 1.41 |
| Comparative Example 8 | G | 26.61Nd—3Pr—0.39Dy—1B-bal.Fe | — | — | 0.39 | 1456 | 1.40 |
| Comparative Example 9 | H | 25.5Nd—3Pr—1.5Dy—1B-bal.Fe | — | — | 1.5 | 1720 | 1.36 |
| Comparative Example 10 | I | 17.9Nd—3Pr—9.1Dy—1B-bal.Fe | — | — | 9.1 | 2960 | 1.12 |

respective raw material powders for use in the production of the rare earth magnets of Examples 51 to 56 were prepared.

On the other hand, Rare Earth Alloy Powder b having a component composition of, in terms of mass %, 29% Pr-0.8% Dy-1% B-0.5% Ga-bal. Fe (the case where Dy was previously added at the melting of the rapid-quenched alloy), and Rare Earth Alloy Powder c having a component composition of, in terms of mass %, 28.2% Pr-1.6% Dy-1% B-0.5% Ga-bal. Fe (the case where Dy was previously added at the melting of the rapid-quenched alloy) were prepared by the same procedure as in the production of Rare Earth Alloy Powder a.

Incidentally, in the production of the rare earth magnet of Comparative Example 11, Rare Earth Alloy Powder a was used directly; in the production of the rare earth magnet of Comparative Example 12, Rare Earth Alloy Powder b was used directly; and in the production of the rare earth magnet of Comparative Example 13, Rare Earth Alloy Powder c was used directly.

(Cold Molding)

Into a cold press mold, 55 grams of each raw material powder or each of rare earth alloy powders a to c was loaded and formed by applying a pressure of 3 ton/cm$^2$ to produce a cylindrical cold compact (outer diameter: 23 mm, inner diameter: 14 mm, height: 30 mm).

(Hot Molding)

The cold compact was set in a hot press mold and formed by heating the mold at 800° C. in an argon atmosphere and applying a pressure of 3 ton/cm$^2$ for about 15 seconds to produce a densified cylindrical hot compact having a height of about 20 mm.

(Hot Plastic Working)

The hot compact was set in a mold of backward extrusion equipment and backward extruded by heating the mold at 850° C. in the atmosphere to obtain a hot plastic worked body deformed in terms of the inner diameter and height (outer diameter: 23 mm, inner diameter: 18 mm, height: 40 mm), and the unextruded bottom portion was cut off. In this way, a cylindrical rare earth magnet having magnetic anisotropy in the radial direction was produced.

(Microstructure of Rare Earth Magnet)

A specimen was cut out from each of the rare earth magnets of Examples 51 to 56 and embedded in a resin and after polishing and etching, the specimen was observed by SEM. As a result, a microstructure composed of a lot of plate-like grains and a grain boundary phase surrounding the periphery thereof was observed.

Also, an image of each structure was photographed and the grain size was determined. At this time, the calculation of the grain size was performed by drawing several straight lines in an image when the C plane of the rare earth magnet was photographed (magnification: 10,000 times), measuring the lengths of 50 pieces of grains in total, and determining the average of the lengths measured.

In addition, the concentration of the rare earth element in the grains and the grain boundary phase was examined using an EDX analyzer attached to SEM, as a result, the magnet of Comparative Example 11 was confirmed to contain grains including a $Pr_2Fe_{14}B$ phase as the main phase and be rich in Pr in the grain boundary phase. Also, the magnet of Example 53 was confirmed to contain grains including a $Pr_2Fe_{14}B$ phase as the main phase and be richer in Dy in the grain boundary phase than in the grains.

As for the rare earth magnet of Example 53 (containing 1 mass % of a 80Dy-20Co alloy powder, with the pure Dy portion corresponding to 0.8 mass %), EDX analysis was further performed at the magnet surface part, the magnet central part and the intermediate part thereof (region of 10 μm×10 μm), and the concentration of element Dy was measured for each region. In this regard, as the concentration of element Dy at the magnet surface part, the concentration of element Dy at the part which is at a depth of 10 μm from the outermost surface of the cylindrical magnet was measured. As the concentration of element Dy at the magnet central part, the concentration of element Dy at the part corresponding to the average of the inner diameter and outer diameter of the cylindrical magnet was measured. As the concentration of element Dy at the intermediate part, the concentration of element Dy at the part intermediate between the magnet surface part and the magnet central part was measured. As a result, the concentration of element Dy was 0.83% at the magnet surface part, 0.82% at the magnet intermediate part, and 0.84% at the magnet central part. Namely, the concentration difference of the element RH in the depth direction from the surface part of the magnet to the inside of the magnet was 2.4%. Consequently, it was confirmed that the rare earth magnet according to the invention is extremely excellent in uniformity of concentration of element Dy over the entire magnet, in comparison with conventional gradient sintered magnet (see, data of parts distant at 10 μm or 500 μm from the surface described in Table 1 of JP-A-2006-303436).

These results confirm that the element Dy is concentrated in the grain boundary phase and at the same time, the element Dy is present with an almost constant concentration distribution from the surface part of the magnet to the central part of the magnet. That is, it is revealed that according to the present invention, the Dy concentration inside of the magnet is distinctly homogeneous compared with the method of causing an element Dy to diffuse and penetrate from the magnet surface. Incidentally, it is easy to infer from the Dy concentration distribution results of Example 53 that also in other Examples, the element Dy is similarly distributed in the grain boundary phase.

(Measurement of Magnetic Characteristics)

An arced magnet piece (4 (height)×4 (width)×2.5 (thickness) mm) obtained by cutting each of the cylindrical rare earth magnets produced above into 4 mm in the height direction and further circumferentially dividing it into 16 parts was measured for the magnetism by using a vibrating sample magnetometer (VSM), and the coercive force (Hcj) and remanence (Br) were determined by performing a demagnetizing field correction.

Various conditions and results of Experiment 7 are shown together in Table 7.

TABLE 7

| | Raw Material Powder | | | | | Hcj | Br |
|---|---|---|---|---|---|---|---|
| | R—X—B-Based Alloy | | RH Metal or RH Alloy | | | (Coercive | |
| | | Powder Composition (mass %) | Composition (mass %) | Mixing Amount (mass %) | Grain Size (nm) | Force) (kA/m) | (Remanence) (T) |
| Example 51 | a | 29Pr—1B—0.5Ga-bal.Fe | 80Dy—20Co | 0.2 | 266 | 1670 | 1.42 |
| Example 52 | a | 29Pr—1B—0.5Ga-bal.Fe | 80Dy—20Co | 0.4 | 272 | 1730 | 1.41 |
| Example 53 | a | 29Pr—1B—0.5Ga-bal.Fe | 80Dy—20Co | 1 | 286 | 1840 | 1.39 |

TABLE 7-continued

| | Raw Material Powder | | | | | Hcj | |
|---|---|---|---|---|---|---|---|
| | R—X—B-Based Alloy | | RH Metal or RH Alloy | | | (Coercive | Br |
| | | Powder Composition (mass %) | Composition (mass %) | Mixing Amount (mass %) | Grain Size (nm) | Force) (kA/m) | (Remanence) (T) |
| Example 54 | a | 29Pr—1B—0.5Ga-bal.Fe | 80Dy—20Co | 2 | 301 | 2050 | 1.37 |
| Example 55 | a | 29Pr—1B—0.5Ga-bal.Fe | 80Dy—20Co | 4 | 308 | 2340 | 1.33 |
| Example 56 | a | 29Pr—1B—0.5Ga-bal.Fe | 80Dy—20Co | 6 | 335 | 2610 | 1.28 |
| Comparative Example 11 | a | 29Pr—1B—0.5Ga-bal.Fe | — | — | 256 | 1520 | 1.43 |
| Comparative Example 12 | b | 29Pr—0.8Dy—1B—0.5Ga-bal.Fe | — | — | 237 | 1720 | 1.38 |
| Comparative Example 13 | c | 28.2Pr—1.6Dy—1B—0.5Ga-bal.Fe | — | — | 226 | 1880 | 1.35 |

Table 7 mainly reveals the followings. That is, the rare earth magnet of Comparative Example 11 is small in the coercive force Hcj compared with rare earth magnets of Examples 51 to 56. This is caused because the magnet is produced using Rare Earth Alloy Powder a alone without mixing a 80Dy-20Co alloy powder with Rare Earth Alloy Powder a.

The rare earth magnets of Comparative Examples 12 and 13 are produced by adding Dy in the same amounts as in the rare earth magnets of Examples 53 and 54 at the melting of the alloy. In the rare earth magnets of Comparative Examples 12 and 13, increase of the coercive force Hcj by virtue of addition of Dy is recognized, but reduction of the remanence Br is slightly large and increase of the coercive force Hcj is relatively small. This is considered to occur because the addition of Dy at the melting of the alloy brings about substitution of Pr in the main crystal by Dy and allows magnetically antiparallel coupling between Dy atom and Fe atom, as a result, the remanence is decreased, and at the same time, the grain boundary phase surrounding the main grain is not uniformly formed.

On the other hand, it is seen that the rare earth magnets of Examples 51 to 56 exhibit a large coercive force Hcj compared with the rare earth magnet of Comparative Example 11. Also, as the mixing amount of the 80Dy-20Co alloy powder is increased, the coercive force Hcj becomes higher. This is considered to result because diffusion of the element Dy into the grain boundary phase proceeds while passing the raw material powder through cold molding, hot molding and hot plastic working and the coercive force Hcj can be efficiently increased.

In all of the rare earth magnets of Examples 51 to 56, the grain size of the main crystal is approximately from 0.2 to 0.3 μm, and this is an ideal size close to a single domain grain size suitable for obtaining a high coercive force.

8. Experiment 8

(Heat Treatment)

With respect to the rare earth magnet of Example 53 produced in Experiment 7, the arced magnetic piece was loaded into a vacuum heat treatment furnace and heat-treated at 500 to 1,000° C. for 1 hour in an Ar atmosphere. Then, the grain size and magnetic characteristics were measured in the same manner as in Experiment 7.

Various conditions and results of Experiment 8 are shown together in Table 8.

TABLE 8

| | Raw Material Powder | | | | | | Hcj | |
|---|---|---|---|---|---|---|---|---|
| | R—X—B-Based Alloy Powder | | RH Metal or RH Alloy | | | | (Coercive | Br |
| | | Composition (mass %) | Composition (mass %) | Mixing Amount (mass %) | Heat Treatment Conditions | Grain Size (nm) | Force) (kA/m) | (Remanence) (T) |
| Example 57 | a | 29Pr—1B—0.5Ga-bal.Fe | 80Dy—20Co | 1 | 500° C. × 1 h | 314 | 1890 | 1.40 |
| Example 58 | a | 29Pr—1B—0.5Ga-bal.Fe | 80Dy—20Co | 1 | 600° C. × 1 h | 335 | 2020 | 1.39 |
| Example 59 | a | 29Pr—1B—0.5Ga-bal.Fe | 80Dy—20Co | 1 | 700° C. × 1 h | 447 | 2350 | 1.40 |
| Example 60 | a | 29Pr—1B—0.5Ga-bal.Fe | 80Dy—20Co | 1 | 800° C. × 1 h | 478 | 2460 | 1.41 |
| Example 61 | a | 29Pr—1B—0.5Ga-bal.Fe | 80Dy—20Co | 1 | 900° C. × 1 h | 896 | 2250 | 1.39 |
| Example 62 | a | 29Pr—1B—0.5Ga-bal.Fe | 80Dy—20Co | 1 | 1000° C. × 1 h | 1520 | 1650 | 1.37 |
| Comparative Example 12 | b | 29Pr—0.8Dy—1B—0.5Ga-bal.Fe | — | — | — | 237 | 1720 | 1.38 |

Table 8 mainly reveals the followings. That is, when a heat treatment is added, the remanence Br is scarcely changed and the coercive force Hcj is further increased. This is considered to occur because diffusion of the element Dy into the grain boundary phase is accelerated by the heat treatment and the element Dy can be internally diffused more homogeneously into the grain boundary phase.

Also, when the temperature at the heat treatment is from 500 to 900° C., an excellent balance is obtained between the remanence Br and the coercive force Hcj. This is considered to result because, for example, the element Dy is sufficiently diffused into the grain boundary phase, the majority of the element Dy is caused to stay in the grain boundary phase, thereby suppressing substitution with the element Pr in the grains and restraining reduction of the remanence, the grains are prevented from coarsening, and a high coercive force can be in turn obtained.

On the other hand, when the temperature at the heat treatment becomes 1,000° C., both the remanence Br and the coercive force Hcj tend to decrease. The reason therefor is considered to be ascribable to the fact that the grains grow to exceed a grain size of 1 μm and therefore, the coercive force Hcj is decreased. For this reason, in order to obtain a high coercive force Hcj, controlling the grain size to 1 μm or less can be said to be effective.

9. Experiment 9

(Preparation of Raw Material Powder)

The rapid-quenched alloy flake having a component composition of, in terms of mass%, 29% Pr-1% B-0.5% Ga-bal. Fe produced in Experiment 7 was pulverized and sieved to produce Rare Earth Alloy Powder a having a maximum particle diameter of 74 μm or less.

Also, RH alloy melts having various component compositions were projected on a rotating roll surface (rotating roll peripheral velocity: 10 m/sec) to produce rapid-quenched alloy flakes having various component compositions. These rapid-quenched alloy flakes each was further pulverized using a ball mill to produce an RH alloy powder having an average particle diameter of 20 μm. Seven kinds of RH alloy powders, that is, as shown in Table 9 later, a 90Dy-10Co alloy powder, a 80Dy-20Co alloy powder, a 60Dy-40Co alloy powder, a 85Dy-15Fe alloy powder, a 87Dy-13Mn alloy powder, 90Dy-10Cr alloy powder and a 80Tb-20Co alloy powder, were produced. The melting point of these alloys is in the range of 750 to 1,180° C. and is lower than the melting point 1,412° C. of pure Dy metal.

These various RH alloy powders weighed to give a mixing amount of 0.5 mass % each was added to Rare Earth Alloy Powder a and mixed by a ball mill (solvent: cyclohexane) for 10 minutes and after drying the solvent, the powder was collected. In this way, respective raw material powders for use in the production of the rare earth magnets of Examples 63 to 69 were prepared.

Incidentally, in the production of the rare earth magnet of Comparative Example 14, Rare Earth Alloy Powder d of 29.4% Pr-0.4% Dy-1% B-0.5% Ga-bal. Fe was used, where 0.4 mass % of Dy was added at the melting of the alloy to become almost equal to the mass % of Dy in the raw material powder above.

(Cold Molding)

Into a cold press mold, 80 grams of each raw material powder was loaded and formed by applying a pressure of 4 ton/cm$^2$ to produce a rectangular cold compact (43 mm×38 mm×10 mm).

(Hot Molding)

The cold compact was set in a hot press mold and formed by heating the mold at 820° C. in an argon atmosphere and applying a pressure of 3 ton/cm$^2$ for about 20 seconds to produce a densified hot compact of 28 mm×38 mm×10 mm having a relative density reaching 99%.

(Hot Plastic Working)

The hot compact was set in a press mold and extruded while compression deforming it by heating the mold at 800° C. in an Ar atmosphere to produce a strip hot plastic worked body (18 mm×59 mm×10 mm).

(Heat Treatment)

The hot plastic worked body was cut into a size of 10 mm (diameter)×7 mm (height) by using a wire electric discharge machine and heat-treated at 800° C. for 30 minutes in a vacuum. Then, the magnetic characteristics were measured in the same manner as in Experiment 7.

Various conditions and results of Experiment 9 are shown together in Table 9.

TABLE 9

| | Raw Material Powder | | | | | Hcj | Br |
|---|---|---|---|---|---|---|---|
| | R—X—B-Based Alloy | | RH Metal or RH Alloy | | | (Coercive | |
| | | Powder Composition (mass %) | Composition (mass %) | Mixing Amount (mass %) | Heat Treatment Conditions | Force) (kA/m) | (Remanence) (T) |
| Example 63 | a | 29Pr—1B—0.5Ga-bal.Fe | 90Dy—10Co | 0.5 | 800° C. × 30 min | 1970 | 1.41 |
| Example 64 | a | 29Pr—1B—0.5Ga-bal.Fe | 80Dy—20Co | 0.5 | 800° C. × 30 min | 2110 | 1.42 |
| Example 65 | a | 29Pr—1B—0.5Ga-bal.Fe | 60Dy—40Co | 0.5 | 800° C. × 30 min | 2060 | 1.40 |
| Example 66 | a | 29Pr—1B—0.5Ga-bal.Fe | 85Dy—25Fe | 0.5 | 800° C. × 30 min | 1950 | 1.41 |
| Example 67 | a | 29Pr—1B—0.5Ga-bal.Fe | 87Dy—13Mn | 0.5 | 800° C. × 30 min | 2030 | 1.39 |
| Example 68 | a | 29Pr—1B—0.5Ga-bal.Fe | 90Dy—10Cr | 0.5 | 800° C. × 30 min | 1890 | 1.41 |
| Example 69 | a | 29Pr—1B—0.5Ga-bal.Fe | 80Tb—20Co | 0.5 | 800° C. × 30 min | 2270 | 1.39 |
| Comparative Example 14 | d | 29.4Pr—0.4Dy—1B—0.5Ga-bal.Fe | — | — | — | 1610 | 1.41 |

Table 9 mainly reveals the followings. That is, although the mixing amount is relatively small of 0.5 mass %, in either case of using a Dy-based (Examples 63 to 68) or Tb-based (Example 69) RH alloy powder, a high coercive force Hcj is also obtained as compared with Comparative Example 4 where the rare earth magnet was produced by adding almost the same amount of Dy. In addition, since the melting point of each RE alloy decreases by the formation of an eutectic alloy, it is understood that an effect of accelerating diffusion into the grain boundary is produced by the heat treatment.

Also, as seen from comparison between Example 64 and Example 69, the increase of the coercive force Hcj is larger when using a Tb-based alloy than when using a Dy-based alloy. This is attributable to the fact that the crystal magnetic anisotropy of Tb is larger than that of Dy.

In addition, it is seen that the coercive force Hcj and the remanence Br can be adjusted by appropriately selecting the additive element of the RH alloy.

10. Experiment 10

(Preparation of Raw Material Powder)

As shown in Table 10 later, Rare Earth Alloy Powder a having a component composition of, in terms of mass %, 29% Pr-1% B-0.5% Ga-bal. Fe, Rare Earth Alloy Powder e having a component composition of, in terms of mass %, 27% Pr-2%

Nd-1% B-0.6% Ga-bal. Fe, Rare Earth Alloy Powder f having a component composition of, in terms of mass %, 22% Pr-5% Nd-1% B-0.5% Ga-bal. Fe, Rare Earth Alloy Powder g having a component composition of, in terms of mass %, 19% Pr-10% Nd-1% B-0.5% Ga-bal. Fe, Rare Earth Alloy Powder h having a component composition of, in terms of mass %, 14% Pr-15% Nd-1% B-0.5% Ga-bal. Fe, and Rare Earth Alloy Powder i having a component composition of, in terms of mass %, 29% Nd-1% B-0.5% Ga-bal. Fe were produced in the same manner as in Experiment 7.

A 80Dy-20Co alloy powder weighed to give a mixing amount of 1 mass % was added to each of Rare Earth Alloy Powders a, e, f, g, h and i and mixed by a ball mill (solvent: cyclohexane) for 10 minutes and after drying the solvent, the powder was collected. In this way, respective raw material powders for use in the production of the rare earth magnets of Examples 70 to 75 were prepared.

Incidentally, in the production of the rare earth magnet of Comparative Example 12, Rare Earth Alloy Powder b produced in Experiment 7 (an alloy powder produced by previously adding Dy at the melting of the rapid-quenched alloy) was used directly.

(Cold Molding→Hot Molding→Hot Plastic Working→Heat Treatment)

As for the subsequent processes, cold molding, hot molding and hot plastic working were performed in the same manner as in Experiment 9, and a heat treatment was further performed at 750° C. for 1 hour in an Ar atmosphere. Then, the magnetic characteristics were measured in the same manner as in Experiment 1.

Various conditions and results of Experiment 10 are shown together in Table 10.

TABLE 10

| | | Raw Material Powder | | | | Hcj | Br |
|---|---|---|---|---|---|---|---|
| | | R—X—B-Based Alloy | RH Metal or RH Alloy | | | (Coercive | |
| | | Powder Composition (mass %) | Composition (mass %) | Mixing Amount (mass %) | Heat Treatment Conditions | Force) (kA/m) | (Remanence) (T) |
| Example 70 | a | 29Pr—1B—0.5Ga-bal.Fe | 80Dy—20Co | 1 | 750° C. × 1 h | 2380 | 1.38 |
| Example 71 | e | 27Pr—2Nd—1B-0.6Ga-bal.Fe | 80Dy—20Co | 1 | 750° C. × 1 h | 2360 | 1.39 |
| Example 72 | f | 22Pr—5Nd—1B—0.5Ga-bal.Fe | 80Dy—20Co | 1 | 750° C. × 1 h | 2330 | 1.39 |
| Example 73 | g | 19Pr—10Nd—1B—0.5Ga-bal.Fe | 80Dy—20Co | 1 | 750° C. × 1 h | 2280 | 1.39 |
| Example 74 | h | 14Pr—15Nd—1B—0.5Ga-bal.Fe | 80Dy—20Co | 1 | 750° C. × 1 h | 2230 | 1.40 |
| Example 75 | i | 29Nd—1B—0.5Ga-bal.Fe | 80Dy—20Co | 1 | 750° C. × 1 h | 2190 | 1.41 |
| Comparative Example 12 | b | 29Pr—0.8Dy—1B—0.5Ga-bal.Fe | — | — | — | 1720 | 1.38 |

Table 10 mainly reveals the followings. That is, in either case of a (Pr,Nd)-based rare earth magnet (Examples 71 to 74) where Pr of the pure Pr-based rare earth magnet (Example 70) is partially substituted by Nd, or a pure Nd-based rare earth magnet (Example 75), the coercive force Hcj can be increased similarly. In the pure Pr-based rare earth magnet (Example 70) and the (Pr,Nd)-based rare earth magnet (Examples 71 to 74), the remanence Br is slightly lower but the coercive force Hcj is greatly high as compared with the pure Nd-based rare earth magnet (Example 75). It is understood from these results that R in the present invention is preferably composed of mainly Pr or mainly Pr and Nd, and in this case, a rare earth magnet excellent in terms of magnetic characteristics is obtained.

11. Experiment 11

(Preparation of Raw Material Powder)

An ingot was produced by melt-casting a rare earth alloy having a component composition of, in terms of mass %, 30% Pr-2% Co-1% B-0.3% Ga-bal. Fe, and this ingot was loaded into a vacuum furnace. After evacuation, a hydrogen gas was supplied in the process of raising the temperature from room temperature to 780° C. to allow hydrogen to be stored in the alloy ingot, and then the hydrogen was released by means of evacuation. The ingot collapsed through this treatment was pulverized using a stamp mill to produce HDDR Powder j having a maximum particle diameter of 105 μm. Also, HDDR Powder k (a powder produced by previously adding Dy) having a component composition of, in terms of mass %, 29.6% Pr-0.4% Dy-2% Co-1% B-0.3% Ga-bal. Fe was produced in the same manner as above. Also, a 80Dy-20Co alloy powder was produced in the same manner as in Experiment 7.

Thereafter, the 80Dy-20Co alloy powder weighed to give a mixing amount of 0.5 mass % was added to HDDR Powderj and wet mixed in a hexane solvent, and the mixture was naturally dried. In this way, the raw material powders for use in the production of the rare earth magnets of Examples 76 to 79 were prepared.

Incidentally, in the production of the rare earth magnet of Comparative Example 15, HDDR Powder k was used directly.

(Cold Molding)

Into a cold press mold, 5 grams of each raw material powder was loaded and formed by applying a pressure of 2 ton/cm$^2$ while adding a magnetic field of 1,600 kA/m to produce a prismatic cold compact (10 mm×10 mm×10 nm). Here, the cold compacts in Experiments 7 to 10 were magnetically isotropic, but the cold compact in Experiment 11 had magnetic anisotropy, because HDDR Powder k having magnetic anisotropy was used and the cold molding was performed in a magnetic field.

(Hot Molding)

The cold compact was set in a hot press mold and formed by heating the mold at 800° C. in an argon atmosphere and applying a pressure of 3 ton/cm$^2$ for about 15 seconds to produce a prismatic hot compact (10 mm×10 mm×6.7 mm) compressed in the height direction.

(Heat Treatment)

The hot compact was heat-treated at 600 to 900° C. for 1 hour in an Ar atmosphere. The samples after cooling were measured for magnetic characteristics by using a BH tracer.

Various conditions and results of Experiment 11 are shown together in Table 11.

TABLE 11

| | | Raw Material Powder | | | | Hcj | |
|---|---|---|---|---|---|---|---|
| | | R—X—B-Based Alloy | RH Metal or RH Alloy | | | (Coercive | Br |
| | | Powder Composition (mass %) | Composition (mass %) | Mixing Amount (mass %) | Heat Treatment Conditions | Force) (kA/m) | (Remanence) (T) |
| Example 76 | j | 30Pr—2Co—1B—0.3Ga-bal.Fe | 80Dy—20Co | 0.5 | 600° C. × 1 h | 1490 | 1.37 |
| Example 77 | j | 30Pr—2Co—1B—0.3Ga-bal.Fe | 80Dy—20Co | 0.5 | 700° C. × 1 h | 1570 | 1.37 |
| Example 78 | j | 30Pr—2Co—1B—0.3Ga-bal.Fe | 80Dy—20Co | 0.5 | 800° C. × 1 h | 1660 | 1.36 |
| Example 79 | j | 30Pr—2Co—1B—0.3Ga-bal.Fe | 80Dy—20Co | 0.5 | 900° C. × 1 h | 1510 | 1.34 |
| Comparative Example 15 | k | 29.6Pr—0.4Dy—2Co—1B—0.3Ga-bal.Fe | — | — | — | 1410 | 1.37 |

Table 11 mainly reveals the followings. That is, also when HDDR Powder k by an HDDR method is prepared as the raw material powder, similarly to Experiments 7 to 10, a rare earth magnet exhibiting a high coercive force Hcj while suppressing reduction of the remanence Br is produced. Furthermore, in the rare earth magnets of Examples 76 to 79, high magnetic characteristics are obtained as compared with the rare earth magnet of Comparative Example 15 using HDDR Powder k where Dy is previously added.

While the rare earth magnet of the present invention and the production process thereof have been described above, the present invention is not limited to these embodiments and Examples, and various changes and modifications can be made therein without departing from the spirit and scope of the present invention.

The present application is based on Japanese Patent Application No. 2008-175675 filed on Jul. 4, 2008, Japanese Patent Application No. 2009-091688 filed on Apr. 6, 2009 and Japanese Patent Application No. 2009-128779 filed on May 28, 2009, the contents thereof being incorporated herein by reference.

What is claimed is:

1. A rare earth magnet comprising grains including an $R_2X_{14}B$ phase as a main phase, and a grain boundary phase surrounding peripheries of the grains, in which R is at least one element selected from the group consisting of Nd, Pr, Dy, Tb and Ho, and X is Fe or Fe in part substituted by Co;

wherein the grains have an average grain size of 1 μm or less;

wherein an element RH is more concentrated in the grain boundary phase than in the grains, in which the element RH is at least one element selected from the group consisting of Dy, Tb and Ho; and wherein the rare earth magnet has a difference in concentration of the element RH in the depth direction from a surface part of the magnet to an interior of the magnet of within 10%.

2. The rare earth magnet as claimed in claim 1, wherein R contains at least Nd and/or Pr.

3. The rare earth magnet as claimed in claim 1, wherein the content of the element RH is from 0.01 to 10 mass % of the rare earth magnet.

4. The rare earth magnet as claimed in claim 2, wherein the content of the element RH is from 0.01 to 10 mass % of the rare earth magnet.

5. The rare earth magnet as claimed in claim 1, which is formed at least by hot molding a raw material powder containing an R—X—B-based alloy powder mixed or coated with an RH metal and/or an RH alloy.

6. The rare earth magnet as claimed in claim 5, wherein the raw material powder contains from 0.01 to 10 mass % of the RH metal and/or the RH alloy.

7. The rare earth magnet as claimed in claim 5, wherein the RH alloy contains at least one element selected from the group consisting of Cu, Al, Ga, Ge, Sn, In, Si, Ag, Au, Pd, Co, Fe, Ni, Cr and Mn.

8. A process for producing a rare earth magnet according to claim 1, the process comprising:

a step of preparing a raw material powder containing an R—X—B-based alloy powder mixed or coated with an RH metal and/or an RH alloy, in which R is at least one element selected from the group consisting of Nd, Pr, Dy, Tb and Ho, X is Fe or Fe with a part being substituted by Co, and RH is at least one element selected from the group consisting of Dy, Tb and Ho;

a step of cold molding said prepared raw material powder to obtain a cold compact; and a step of hot molding said obtained cold compact to obtain a hot compact or subjecting said obtained hot compact further to hot plastic working to obtain a hot plastic worked body.

9. The process as claimed in claim 8, wherein the raw material powder contains from 0.01 to 10 mass % of the RH metal and/or the RH alloy.

10. The process as claimed in claim 8, which further comprises a step of subjecting the hot compact or the hot plastic worked body to a heat treatment.

11. The process as claimed in claim 9, which further comprises a step of subjecting the hot compact or the hot plastic worked body to a heat treatment.

12. The process as claimed in claim 10, wherein the heat treatment is conducted at a temperature of from 500 to 900° C.

13. The process as claimed in claim 11, wherein the heat treatment is conducted at a temperature of from 500 to 900° C.

14. The process as claimed in claim 8, wherein the RH alloy contains at least one element selected from the group consisting of Cu, Al, Ga, Ge, Sn, In, Si, Ag, Au, Pd, Co, Fe, Ni, Cr and Mn.

15. The rare earth magnet as claimed in claim 1 wherein the grains have an average grain size of 0.5 μm or less.

* * * * *